US011299963B2

(12) United States Patent
Stahl et al.

(10) Patent No.: US 11,299,963 B2
(45) Date of Patent: Apr. 12, 2022

(54) MOBILE WELL SERVICING SYSTEM AND METHOD OF USING THE SAME

(71) Applicant: Hyjack Energy Services Inc., Calgary (CA)

(72) Inventors: Travis Stahl, Calgary (CA); Chris Anstey, Calgary (CA)

(73) Assignee: HYJACK ENERGY SERVICES INC., Calgary (CA)

( * ) Notice: Subject to any disclaimer, the term of this patent is extended or adjusted under 35 U.S.C. 154(b) by 147 days.

(21) Appl. No.: 16/723,291

(22) Filed: Dec. 20, 2019

(65) Prior Publication Data

US 2020/0199976 A1 Jun. 25, 2020

Related U.S. Application Data

(60) Provisional application No. 62/783,833, filed on Dec. 21, 2018.

(51) Int. Cl.

| | |
|---|---|
| ***E21B 7/02*** | (2006.01) |
| ***E21B 41/00*** | (2006.01) |
| ***E21B 15/00*** | (2006.01) |
| ***E04H 12/34*** | (2006.01) |
| ***E21B 33/06*** | (2006.01) |
| ***E21B 19/00*** | (2006.01) |
| ***E21B 19/08*** | (2006.01) |

(52) U.S. Cl.

CPC ..... *E21B 41/00* (2013.01); *E04H 12/345* (2013.01); *E21B 7/023* (2013.01); *E21B 15/00* (2013.01); *E21B 19/008* (2013.01); *E21B 19/08* (2013.01); *E21B 33/06* (2013.01)

(58) Field of Classification Search

CPC ..... E21B 7/02; E21B 7/023; E21B 15/00

See application file for complete search history.

(56) References Cited

U.S. PATENT DOCUMENTS

| | | | | |
|---|---|---|---|---|
| 4,290,495 | A | 9/1981 | Elliston | |
| 6,003,598 | A | 12/1999 | Andreychuk | |
| 6,932,553 | B1 * | 8/2005 | Roodenburg | E21B 15/003 166/343 |
| 7,249,629 | B2 | 7/2007 | Cunningham et al. | |
| 7,469,749 | B2 | 12/2008 | Folk | |
| 2003/0079883 | A1 * | 5/2003 | McCulloch | B66C 23/60 166/379 |

FOREIGN PATENT DOCUMENTS

WO 2016190742 A2 12/2016

* cited by examiner

*Primary Examiner* — Giovanna Wright

(74) *Attorney, Agent, or Firm* — Standley Law Group LLP

(57) ABSTRACT

A mobile well servicing system and method are provided for performing well services. The mobile well servicing system can include a work surface on a platform supporting an equipment such a jack, a blowout preventer (BOP), a coiled tubing (CT) injector and a mast. The mast is pivotable between a first position, with a lifting point positioned over the work surface, and a second position, with the lifting point positioned behind the platform. A hoist winch assembly mounted at the platform raises the equipment from the platform when the mast is at the first position. The equipment then pass through a space between two parallel legs of the mast, and lowered to a wellhead when the mast is at the second position. Multiple tasks such as well completion, change of dynamic temperature sensor (DTS) and electric submersible pump (ESP) can be achieved using this system.

29 Claims, 28 Drawing Sheets

MOBILE WELL SERVICING SYSTEM AND METHOD OF USING THE SAME

FIELD

Embodiments herein relate to servicing equipment and methods for oil and gas wells generally. In particular, embodiments herein relate to a mobile well servicing system and method for operating wellbore servicing equipment such as for running continuous coiled tubing, electronic submersible pumps, and dynamic temperature sensors (DTS), for conventional jointed pipe and for hydraulic workover applications.

BACKGROUND

Drilling a well for tapping underground reservoirs of oil and gas is an expensive procedure that has made the petroleum exploration industry a competitive one where cost improving advancements are continually sought. Oil and gas drilling is currently most commonly accomplished with rotary rigs using conventional jointed pipe sections. These rigs typically have jackknife type masts that are tall enough to handle up to three stands of jointed pipe and thereby facilitate faster "trips" in and out of the well bore, yet drilling procedures today remain very much the same for the past few decades.

Once drilling is finished and the casing has been cemented in the wellbore, the drilling rig is usually moved, and a smaller, truck mounted service rig is brought in to complete the well. Completing a successful well, namely preparing it for production, typically includes the steps of running casing into the well, installing a wellhead, and installing a production tubing string. Production tubing strings today may consist of continuous coiled tubing (referred to herein as "CT") carried on a spool on a CT service rig. The CT is injected inside the well casing using a CT injector head to straighten and push the CT down.

Mobile well service rigs with a mast for handling conventional pipe sections are currently being used for well completion. However, most mobile service rigs require separate transport for their respective services, and all are of limited application. For example, current service rigs incorporate a mast for effectively handling pipe strings in and out of the well. No one service rig provider offers a service rig adapted to handle other types of well servicing technology. Mobile rigs for performing CT well servicing also exist, but most CT rigs in use today require the use of a separate crane to manipulate the blow-out-preventer (BOP) and CT injectors that are required for CT servicing. Although there exist rigs which have a collapsible mast along which an injector head which can be raised or lowered without the need of a crane, these rigs suffer from various short comings. For instance, mobile service rigs are typically not adapted for servicing wells with independent CT, that is, CT located off of the rig, or for performing other tasks such as independent snubbing of heavy strings of jointed pipes. Such rigs also require time consuming installation and removal of the injector head and the BOP.

Current mobile service rigs suffer from further disadvantages. They can encounter difficulty in placing production tubing and other production equipment all the way to the toe of deviated wellbores, such as those wells with short vertical depth and long horizontal depth in steam-assisted gravity drainage (SAGD) operations. Such conditions may in turn cause the production tubing and other production equipment to "friction out", wherein there is no longer sufficient force created by the weight of the tubing in the vertical section of the wellbore to push the tubing in the lateral section of the wellbore farther downhole. When such a situation occurs, the tubing must be "pushed" into the wellbore by applying forces in addition to the weight of the tubing in order to position the production tubing at the desired depth. Such pushing can be performed by a separate jacking rig for jacking the tubing downhole, or installing a heavy pipe or drill collar at a vertical portion of the tubing string to provide additional weight thereto. However, using a separate jacking rig is inefficient and time-consuming, as the jacking rig must be located on-site throughout the completion operations to be on stand-by in the event the tubing frictions out, and the rig must be aligned with and installed on the wellbore when its services are needed. Additionally, use of heavy pipes or drill collars is not always feasible.

Current mobile service rigs also require laborious and time-consuming procedures when rigging in equipment such as heavy weight pipe and/or portable pipe jacking units to position production tubing and other production equipment at surface. Each additional service, and corresponding additional equipment, added to the mobile service rig increases the demands on the oil and gas operator's time, cost, and efficiency.

Further, adding services and equipment to a mobile service rig is difficult, as the commensurate weight increase of each added capability may result in the rig exceeding the maximum permitted seasonal weights for roads leading to and from the wellsite. For example, the masts of current service rigs are typically rated for loads of about 80,000-120,000daN, and heavy-duty masts can be rated for 130,000-150,000 daN, in order to lift heavy tubing strings. Accordingly, the construction of such masts is quite robust and heavy. Such rigs are often over the legal weight for roads leading to and from the wellsite, and operators must acquire permits before to transport the rigs on said roads. Heavier rigs are restricted to being transported during the winter only, which significantly limits the times of year during which certain operations, such as servicing deep wells, can be performed. There is also a significant cost to loading such heavy rigs onto trailers for transportation.

SUMMARY

Therefore, there remains a need for a multi-task service rig system which overcomes the many disadvantages of current mobile service rigs and CT service rigs. The multi-task service rig system should be mobile and combine on a single platform and have the ability to transport and operate equipment for conventional pipe servicing, coiled tubing servicing, snubbing servicing, and electronic submersible pump and dynamic temperature sensors installation, while remaining under the maximum permitted seasonal weights for the roads that the rig is to travel on.

According to one aspect, a mobile well servicing system is provided for performing multiple tasks on wellsite. The mobile well servicing system may comprise a platform supported by a plurality of wheels; a work surface supported by the platform; a first piece of servicing equipment positionable on the work surface and a mast comprising two parallel legs having proximal ends and distal ends. The proximal ends may be pivotally connected to the platform. A lifting point is positioned at the distal ends of the two parallel legs, and a passthrough space is defined between the two parallel legs. A hoist winch assembly has a lifting device connectable to the first piece of servicing equipment and suspended from the lifting point. The mast is pivotable around the proximal ends of the two parallel legs between a first position, with the lifting point positioned over the work surface, and a second position, with the lifting point positioned behind the platform The first piece of servicing equipment is raised off of the work surface of the platform by the hoist winch assembly when the mast is in the first position. The first piece of servicing equipment is then moved through the passthrough space as the mast is moved towards the second position. When the mast is in the second position, the hoist winch assembly lowers the first piece of servicing equipment to a wellhead.

According to one aspect, the two parallel legs of the mast are telescoping between a lowered positioned and a raised position. Each of the two parallel legs may comprise a hollow main leg and a telescoping leg received in the hollow main leg. When the mast is moved from the first position to the second position, the two parallel legs are in the lowered positioned with the telescoping leg received in the main leg. When the mast is in the second position, the two parallel legs are moved from the lowered position to the raised position with the telescoping leg extended from the main leg.

The well servicing system may comprise a second piece of servicing equipment. The second piece of servicing equipment may be moved after the first servicing equipment has been moved to the wellhead. According to another aspect, the first servicing and the second piece of servicing equipment may be connected at the platform and moved to the wellhead together.

According to a further aspect, a method of using a well servicing system to perform well services is provided, wherein the well servicing system comprises a platform supported by a plurality of wheels; a work surface supported by the platform; a first piece of servicing equipment positionable on the work surface; a mast comprising two parallel legs having proximal ends and distal ends, the proximal ends pivotally connected to the platform, a lifting point positioned at the distal ends of the two parallel legs, and a passthrough space defined between the two parallel legs; and a hoist winch assembly having a lifting device connectable to the first piece of servicing equipment and suspended from the lifting point. The method comprises: providing the well servicing system; moving the well servicing system close to a wellhead; raising the mast from a recumbent position where the mast is substantially horizontal to the platform; pivoting the mast around the proximal ends of the two parallel legs to a first position, with the lifting point positioned over the work surface; using the hoist winch assembly, lifting the first piece of servicing equipment off of the work surface; pivoting the mast around the proximal ends of the two parallel legs and moving the first piece of servicing equipment through the passthrough space, to a second position with the lifting position positioned behind the platform and over the wellhead; using the hoist winch assembly, lowering the first equipment to the wellhead.

According to another aspect, the method comprises extending the legs of the mast at the second position to place the mast in a full operational position. The method may further comprise performing a well service involves at least one of: joined pipes; and coiled tubing, while the mast in the full operational position.

According to a further aspect, the well service includes at least one of: installing an electric submersible pump in the well; changing an electric submersible pump; changing power cable in the well; installing a dynamic temperature sensor in the well; and changing a dynamic temperature sensor in the well.

DESCRIPTION

A mobile well servicing system is provided herein for transporting and operating equipment for a number of wellbore services on a single platform, thereby providing time and cost savings. Such wellbore services may include, for example, making/breaking up jointed pipes and jacking said pipes into or out of a wellbore, injecting/retrieving coiled tubing (CT), and running in an electric submersible pump (ESP), for example at the end of a string of jointed pipe with an electrical wireline retained thereto. The equipment on the mobile well servicing system may also configured to provide significant weight reductions relative to existing mobile servicing rigs, thus allowing the mobile well servicing system to transport the equipment necessary for performing a number of different services on a single platform while remaining under the maximum allowable seasonal weight limits for roads leading to the wellsite.

Figure 1:
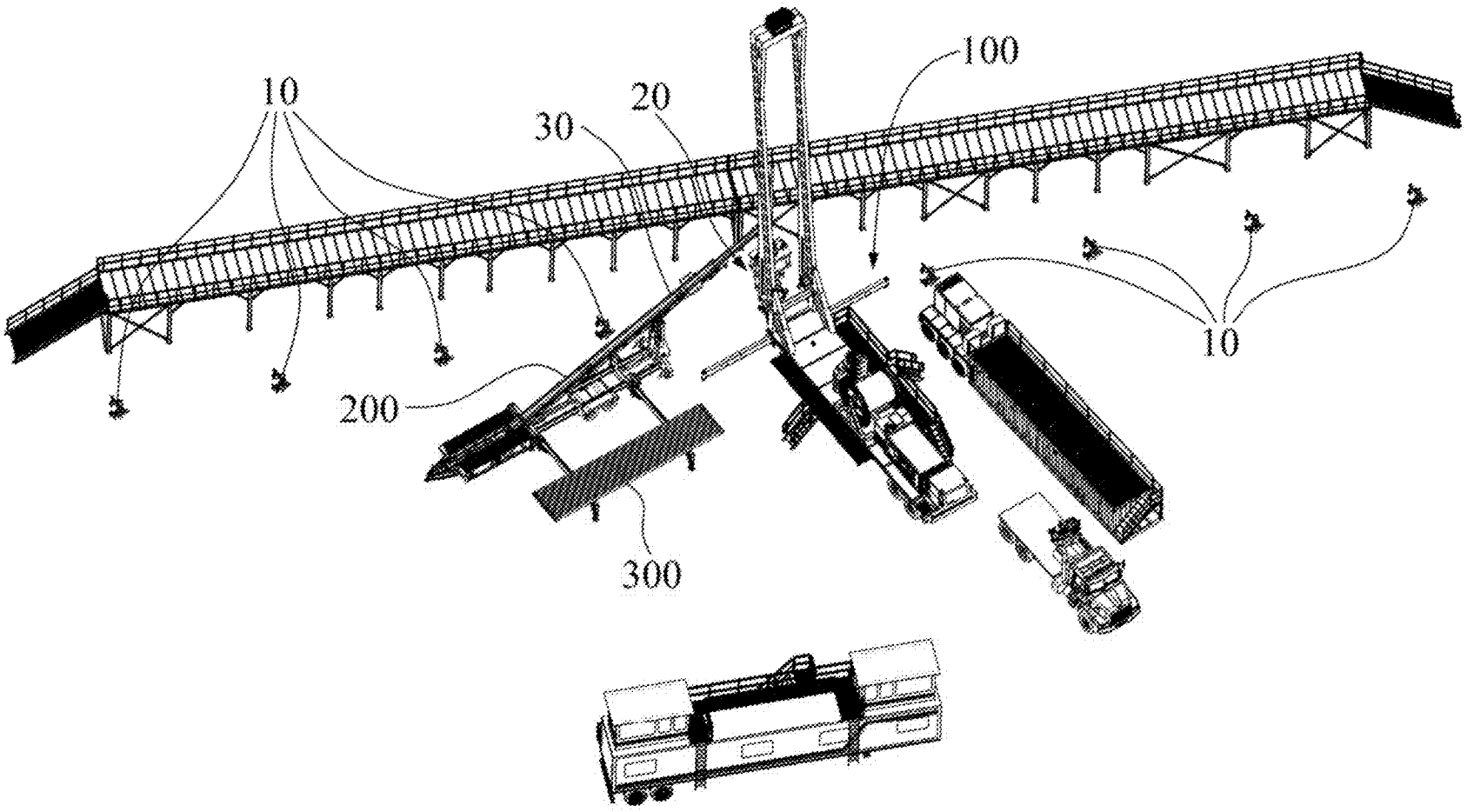
FIG. 1 is a perspective view of a mobile well servicing system in use at a wellsite having a plurality of wells.
Figure 2A:
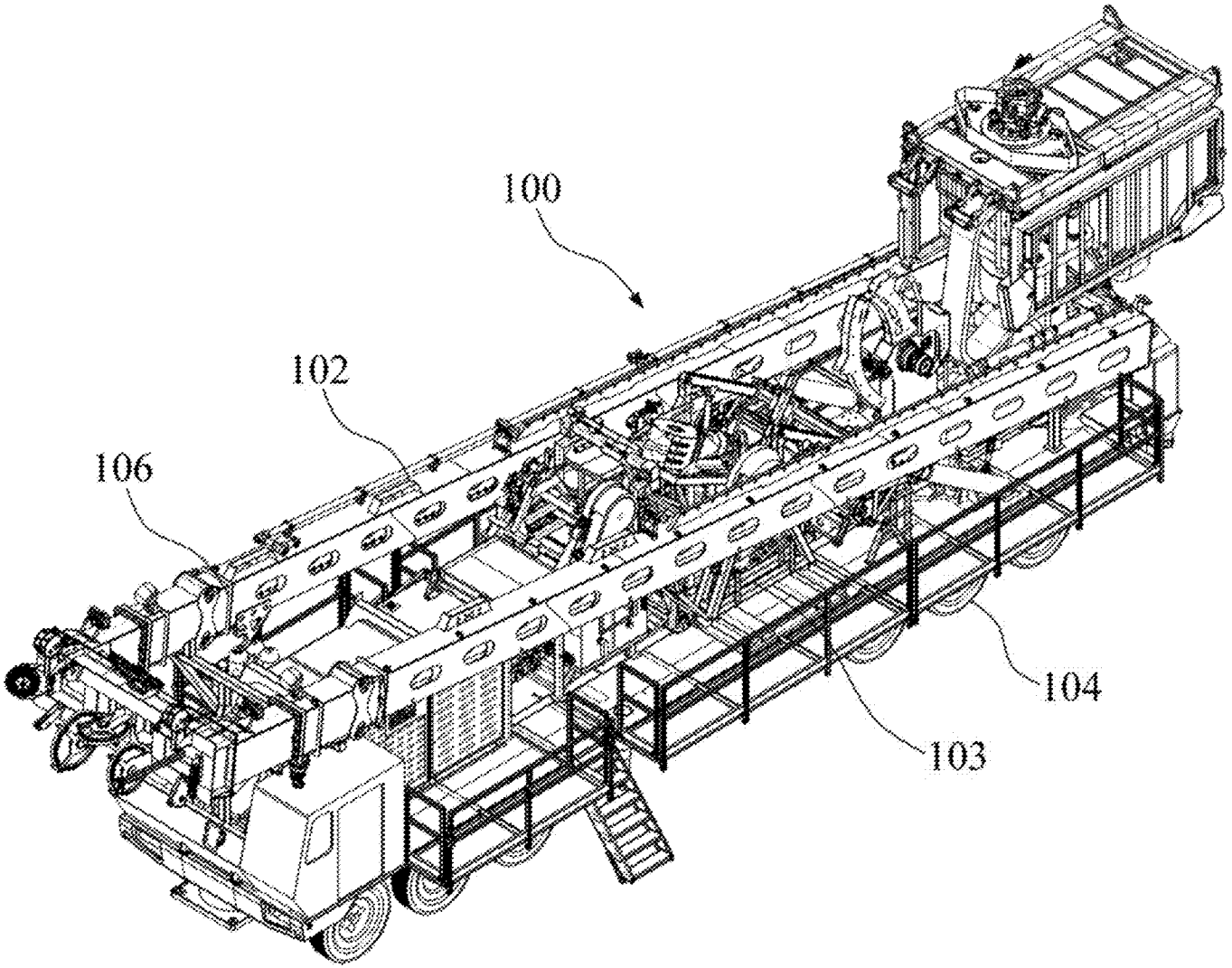
FIG. 2A is a perspective view of the mobile well servicing system of FIG. 1 in a recumbent position.
Figure 2B:
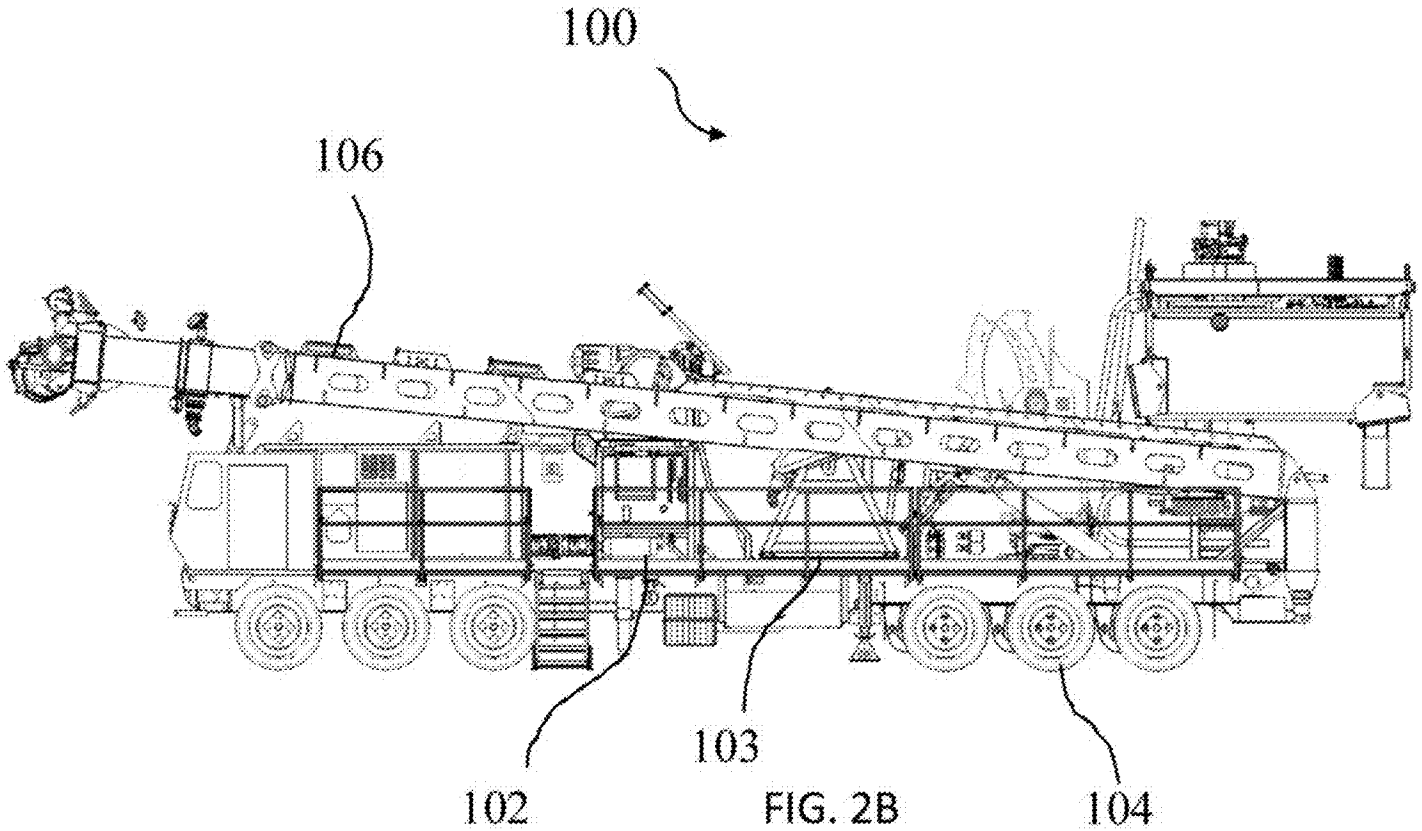
FIG. 2B is a side elevation view of FIG. 2A.

With reference to FIGS. 1-5, an embodiment of the mobile well servicing system 100 is discussed in detail. FIG. 1 shows an example of the mobile well servicing system 100 serving in an oil field with a plurality of wells 10. In this example, a pipe handler 200 may be located close to the mobile well servicing system 100 for coupling pipes 30 to the mobile well servicing system 100 above a wellhead 20. The pipes may be provided from a pipe rack 300 adjacent to the pipe handler 200.

Further as best shown in FIGS. 2-5, the mobile well servicing system 100 may comprise a mobile platform 102 supported on wheels 104. The platform 102 may include a work surface 103. The mobile well servicing system 100 may also include a mast 106 and a hoist winch assembly 130.

Servicing equipment, such as a jack 108, a blowout preventer (BOP) 110, a CT injector 112, a work floor 113, a hoist winch assembly 130 and power tongs (not shown) may be positionable and stored on the work surface 103.

The hoist winch assembly 130 may include a drawworks that is located on the platform 102. The hoist winch assembly 130 may include a cable 131 and a lifting device 133 shown in FIG. 4A, such as a hook, that is connectable to servicing equipment, joint pipes, etc. to be hoisted using the hoist winch assembly 130. When the hoist winch assembly 130 is working, the lifting device 133 is connected to the servicing equipment, joint pipe, etc. The cable 131 of the hoist winch assembly 130 may run to the top of the mast 106 to a lifting point 127, such as a sheave, where the cable 131 and the lifting device 133 is suspended from this lifting point 127. The cable 131 and the lifting point 127 is suspended from this lifting point 127 and servicing equipment, such as the jack 108, the BOP 110, or CT injector 112, joint pipe, etc. may be raised or lowered by the hoist winch assembly 130, suspended from the lifting point 127.

The mobile well servicing system 100 may also comprise a stand/axle 114 for rotatably supporting a CT spool and/or wireline spool 116. At least one hydraulic system 118 may be placed on a front portion of the work surface 103. The hydraulic system 118 may include a hydraulic reservoir and a pump with hydraulic lines connectable to be in hydraulic communication with the jack 108, the mast 106, the BOP 110, the CT injector 112, the work floor 113 and/or other equipment.

The mobile well servicing system 100 may be a vehicle and have a driver's cab 120 provided at the front end the platform 102 for a driver to transport the mobile well servicing system 100 to a wellsite.

The mast 106 may be configured to support limited vertical loads, and limited lateral and torsional loads, such that the structure of the mast is less capable of loads usually asserted in supporting jointed pipes and/or snubbing relative to the masts or similar structures of existing mobile rigs. Such lighter service structure permits the mast 106 to be lighter than the masts of existing mobile rigs, which reduces the gross vehicle weight and in turn allows additional equipment to be mounted on the mobile well servicing system 100 without exceeding maximum road weight allowances. The jack 108 or other similar devices can be used to manipulate heavier loads.

In one aspect, the mast 106 may comprise two substantially parallel legs 106*a* and 106*b* connected at their distal ends 109 by a transverse beam 126. The lifting point 127 may be provided on this transverse beam 126. The proximal ends 111 of the legs 106*a* and 106*b* are pivotally mounted to a supporting frame 128 supported by the platform 102. A passthrough space 107 is formed between the two parallel legs 106*a*, 106*b* for servicing equipment stored on the work surface 103 to pass through as it is moved by the mobile well servicing system 100 from the work surface 103 to a wellhead. The passthrough space 107 is unobstructed to allow servicing equipment to pass through the passthrough space 107, when the mobile well servicing system 100 is in operation.

The mast 106 may be actuated, for example using hydraulic rams 122 to pivot the mast 106 around the proximal ends 111 of the two parallel legs 106*a*, 106*b* from a recumbent or storage position, wherein the mast 106 is positioned substantially horizontally to the platform 102 for storage and transportation.

Figure 3A:
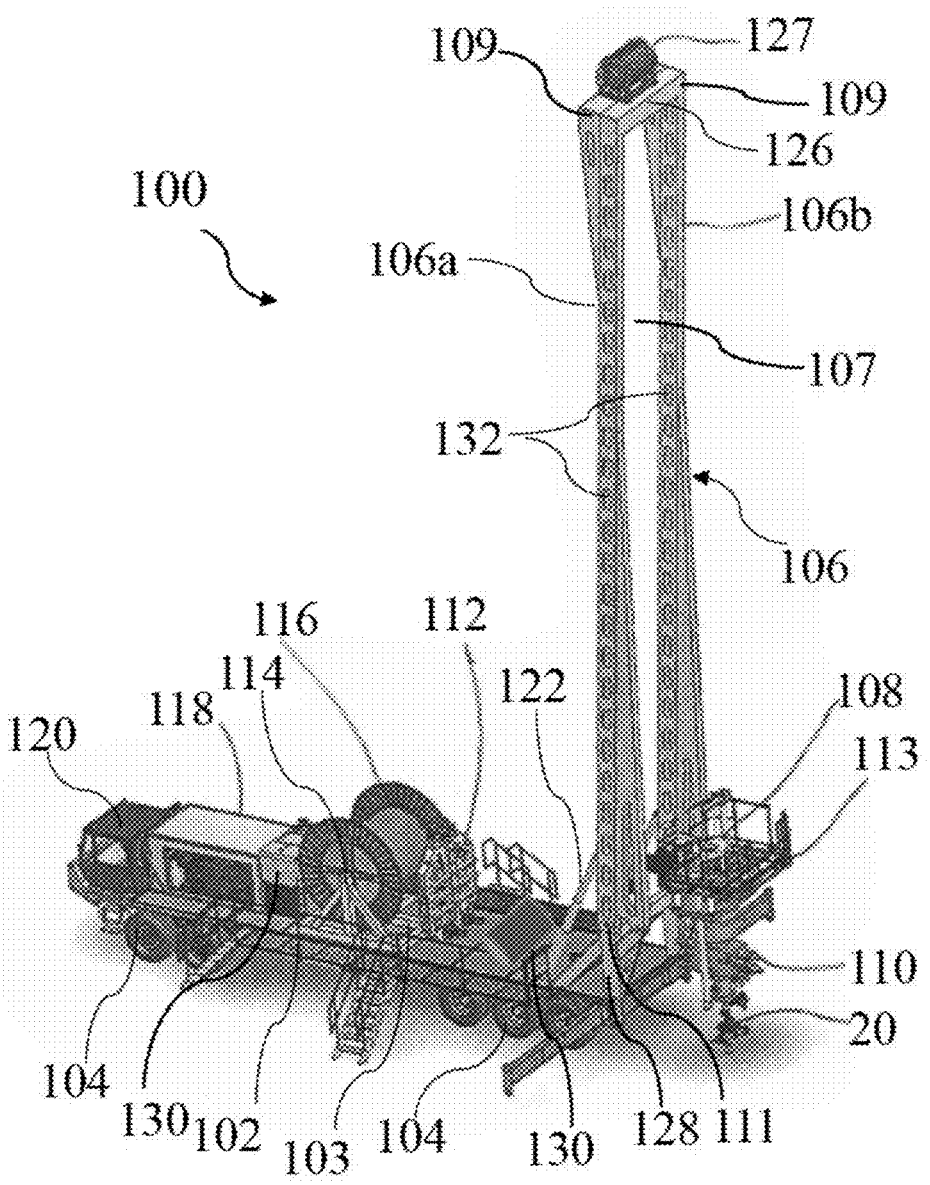
FIG. 3A is a simplified perspective view of the mobile well servicing system of FIG. 1 in isolation and positioned to service a well.
Figure 3B:
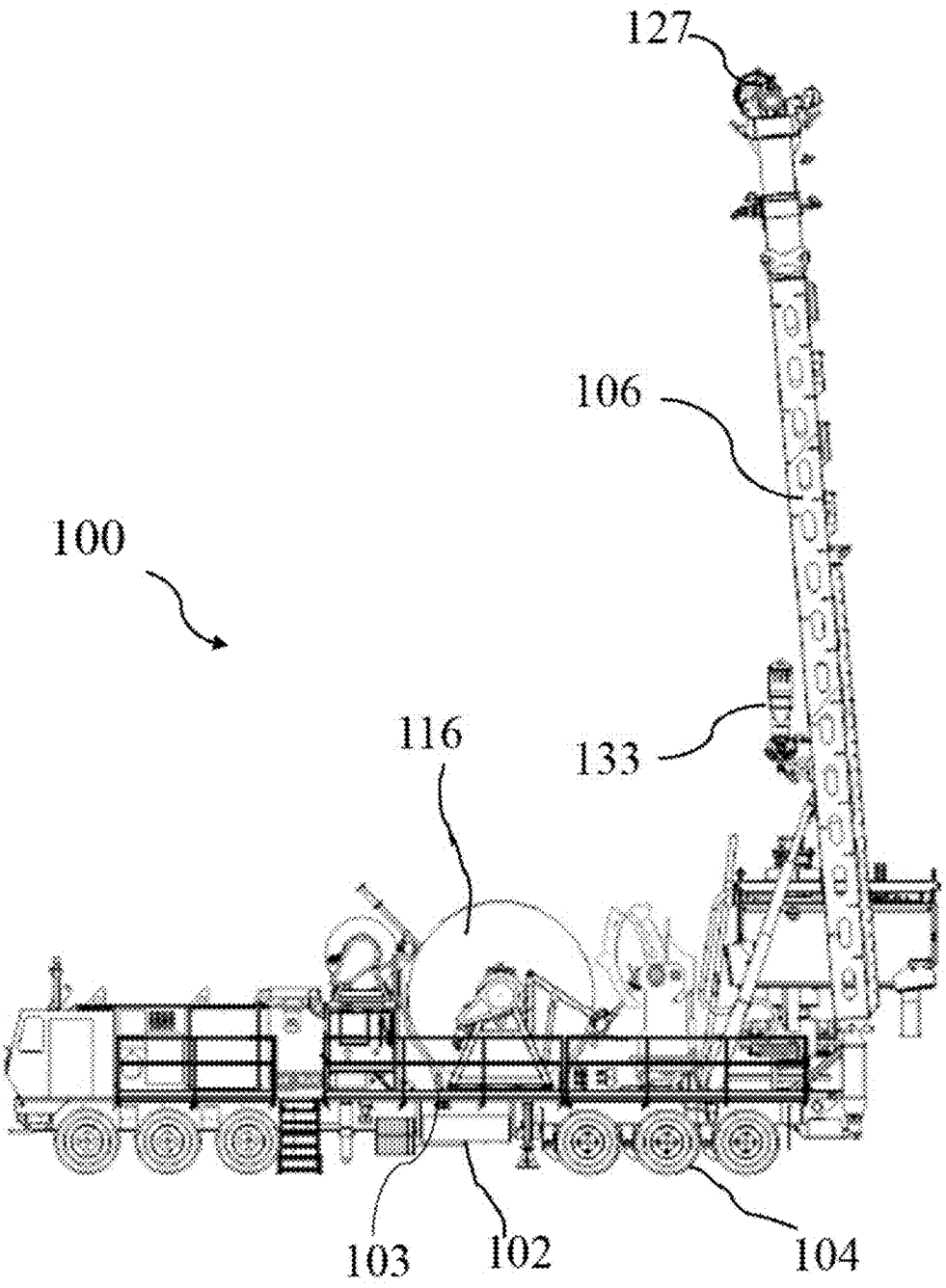
FIG. 3B is a side elevation view of the mobile well servicing system of FIG. 3A with a mast in a first position.

For lifting servicing equipment from the work surface 103, the mast 106 may be actuated, using the hydraulic rams 122, to pivot the mast 106 around the proximal ends 111 of the two parallel legs 106*a*, 106*b*, to a first position, also known as a lifting position, shown in FIG. 3B. In this lifting position, the lifting point 127 can be positioned over the work surface 103 so that the lifting device 133 suspended from the cable is suspended over the work surface 103 where the servicing equipment is located. The lifting device 133 of the hoist winch assembly 130 can be lowered to a first piece of servicing equipment, such as the BOP 110, on the work surface 103 of the platform 102 and the lifting device 133 connected to the first piece of servicing equipment. The cable of the hoist winch assembly 130 which is suspended from the lifting point 127 at the distal ends 109 of the legs 106*a*, 106*b* of the mast 106, may hoist the first piece of servicing equipment up off the work surface 103.

Figure 3C:
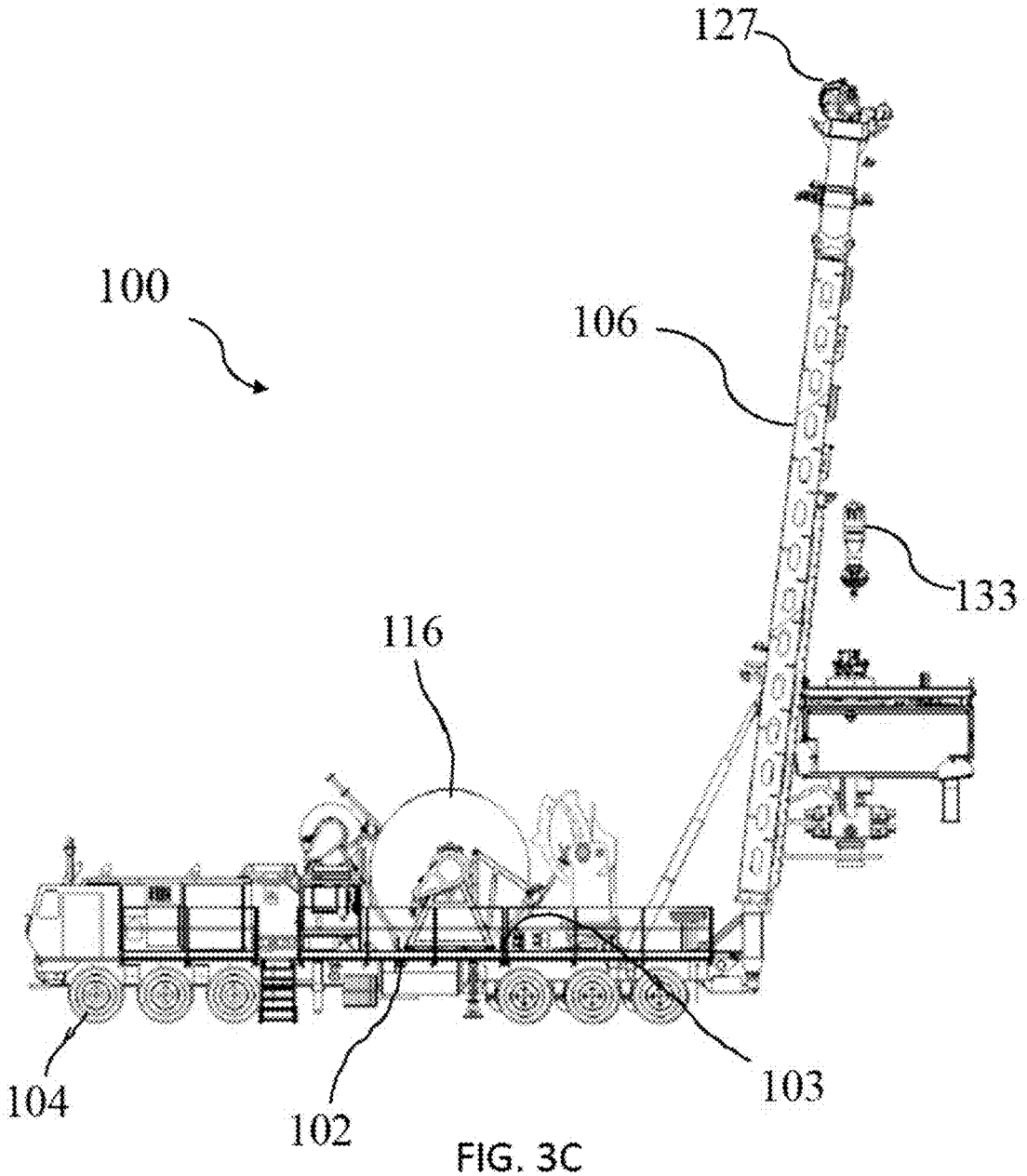
FIG. 3C is a side elevation view of the mobile well servicing system of FIG. 3A with a mast in a second position.

With the first piece of servicing equipment suspended from the lifting point 127 and above the work surface 103 of the platform 102, the mast 106 may then be pivoted from the first position to a second position, with the lifting point 127 positioned behind the platform 102, shown in FIG. 3C. As the mast 106 is pivoted from the first position to the second position, the first piece of servicing equipment is moved through the passthrough space 107 between the parallel legs 106*a*, 106*b* of the mast 106 is pivoted towards the second position.

When the mast 106 is in the second position, the hoist winch assembly 130 may lower the first piece of equipment to the wellhead 20.

After the first piece of servicing equipment such as BOP 110 is moved to the wellhead 20, the mast 106 may be moved back to the first position with the lifting point 127 at the distal ends 109 of the legs 106*a*, 106*b* of the mast 106 positioned over the work surface 103 on the platform 102. A second piece of servicing equipment, such as a jack 108 or a CT injector 112, may be raised off of the work surface 103 of the platform 102 by the hoist winch assembly 130. The second piece of servicing equipment may then be moved through the passthrough space 107 as the mast 106 is moved towards the second position. When the mast 106 is in the second position, the hoist winch assembly 103 may lower the second piece of servicing equipment to the wellhead 20.

In another aspect, the first piece of servicing equipment and the second piece of servicing equipment may be stacked or connected together on the work surface 103. The combined first piece of servicing equipment and the second piece of servicing equipment may be lifted off of the work surface 103 by the hoist winch assembly 130 when the mast 106 is in the first position. The mast 106 may then be pivoted from the first position to the second position causing the combined first piece of equipment and the second piece of equipment to move through the passthrough space 107 to the wellhead 20.

Figure 4A:
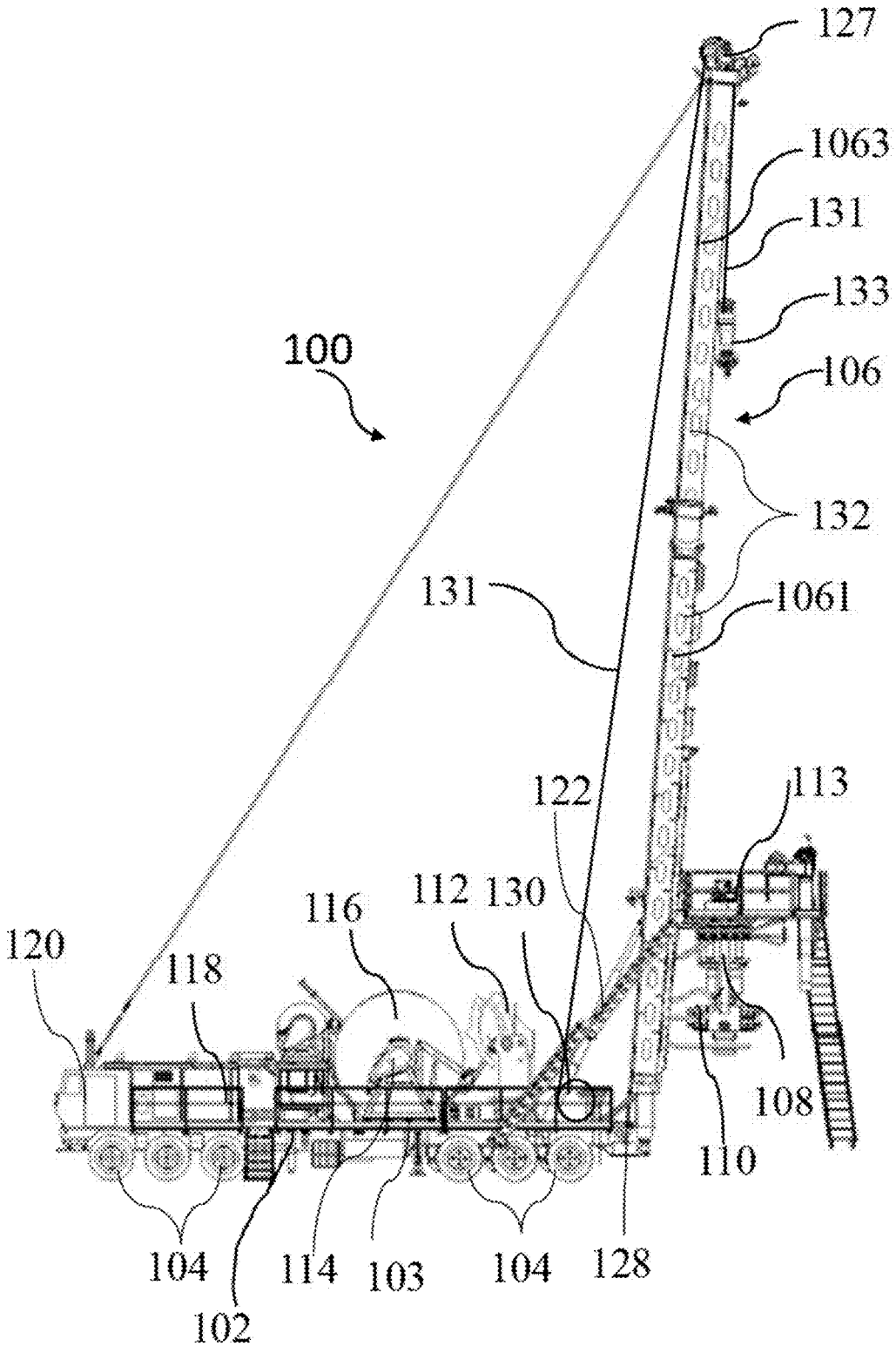
FIG. 4A is a side elevation view of the mobile well servicing system of FIG. 3A with the mast extended to a raised position.
Figure 4B:
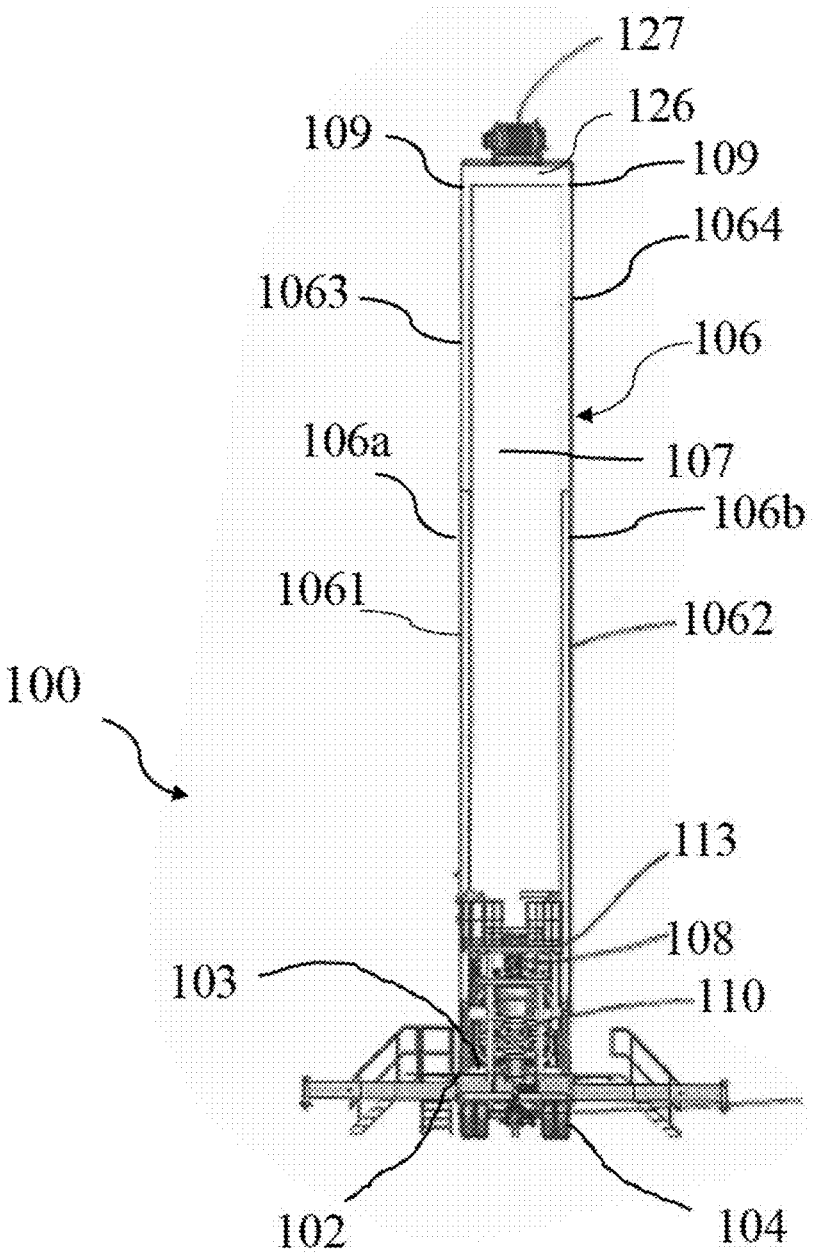
FIG. 4B is a rear elevation view of the mobile well servicing system of FIG. 4A.

In a further aspect, each of the legs 106*a* and 106*b* may be telescoping between a lowered positioned and a raised position, and comprises a main leg and a telescoping leg. For example, as shown in FIGS. 4A and 4B, the leg 106*a* comprises a main leg 1061 and a telescoping leg 1063. Leg 106*b* comprises a main leg 1062 and a telescoping leg 1064. The main leg 1061 and 1062 may generally be hollow and open at one end for receiving the telescoping leg 1063 and 1064, respectively. When the mast 106 is moved from the first position to the second position, the telescoping leg 1063 received in the main leg 1061, and the telescoping leg 1064 is received in the mail leg 1062. The two parallel legs 106*a*, 106*b* may be in their lowered position, shown in FIGS. 3B and 3C. When the two parallel legs 106*a*, 106*b* are in their lowered position, the total height of the mast 106 is approximately the length of main leg 1061 and 1062. The two parallel legs 106*a*, 106*b* can also be placed in their lowered position when the mast 106 is placed in the recumbent position for transport or storage of the mobile well servicing system 100 or when the mast 106 is in the first position to perform lifting tasks and to move servicing equipment to the back of the mobile well servicing system 100.

When the mast 106 is in the second position shown in FIGS. 4A and 4B, the telescoping legs 1063 and 1064 of the mast 106 may be extended from the lowered position to the raised position to extend the height of the mast 106 and therefore the height of the lifting point 127 on the distal ends 109 of the legs 106*a*, 106*b*. The height of the mast 106 in the raised position is approximately the sum of the length of the main leg 1061 and the telescoping leg 1063, as well as the sum of the length of the main leg 1062 and the telescoping leg 1064.

In one aspect, the telescoping legs 1063 and 1064 may be driven by the power of the pressurized hydraulic fluid from the hydraulic system 118 on the platform 102. With the telescoping structure, the mast 106 may be extended from approximate 60 feet to 90 feet, in one embodiment, which may meet the height requirements for different tasks.

In the embodiment depicted in FIGS. 3A-4A, the legs may have a plurality of lightening apertures 132 to provide additional weight savings. As the mast 106 does not need to withstand significant inline or torsional loads, many apertures 132 can be formed in the legs 106*a*, 106*b* of the mast 106 without significant risk of the legs 106*a*, 106*b* buckling under load. The legs 106*a*, 106*b* may also be substantially hollow to achieve further weight savings. In one embodiment, the mast 106 can lift loads up to 40,000 daN.

In another aspect, a piece of servicing equipment, such as the jack 108, may be installed on the wellhead 20 and used to lift and manipulate heavier loads from the wellbore that cannot be lifted by the lightweight mast 106, for example a string of jointed pipe. The jack 108 may be any suitable jacking unit, such as those used in snubbing. For example, the jack 108 can comprise a lower, stationary slip assembly and an upper, travelling slip assembly for releasably and controllably shifting tubulars along a common axis into or out of the wellbore.

In one aspect, the jack 108 and the BOP 110 may be stored on the work surface 103 of the platform 102 when not in service or during transportation. When the mobile well servicing system 100 is on the field site and ready for work, it is positioned close to the wellhead 20. The BOP 110 may be first pulled up by the hoist winch assembly 130, and then lowered down onto the wellhead 20. The BOP 110 may be secured to the wellhead by bolts or other fastening means known in the art. The jack 108 may then be installed on top of the BOP 110 in the same manner. The work floor 113 may also be stacked and mounted on top of the jack 108 or the BOP 110.

In one aspect, the spool stand/axle 114 is used to rotatably retain a CT spool or wireline spool 116, depending on the current service being performed by the mobile servicing platform 100. The spool 116 that is not in use may be stored off the mobile well servicing platform 100, such as on a pickup truck. A fork loader or other suitable means (not shown) can be used to install and remove the spool from a spool stand 114.

Figure 5:
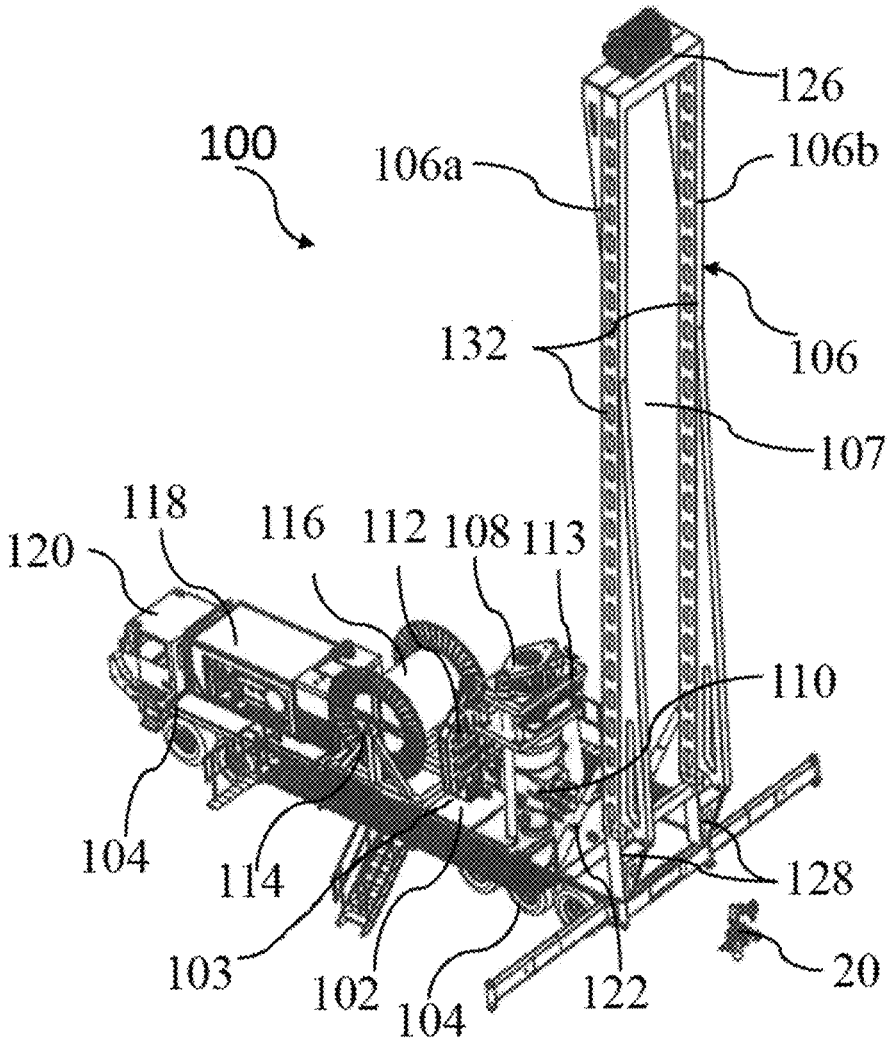
FIG. 5 is a perspective view of the mobile well servicing system of FIG. 3A positioned close to a wellhead ready for service.
Figure 6A:
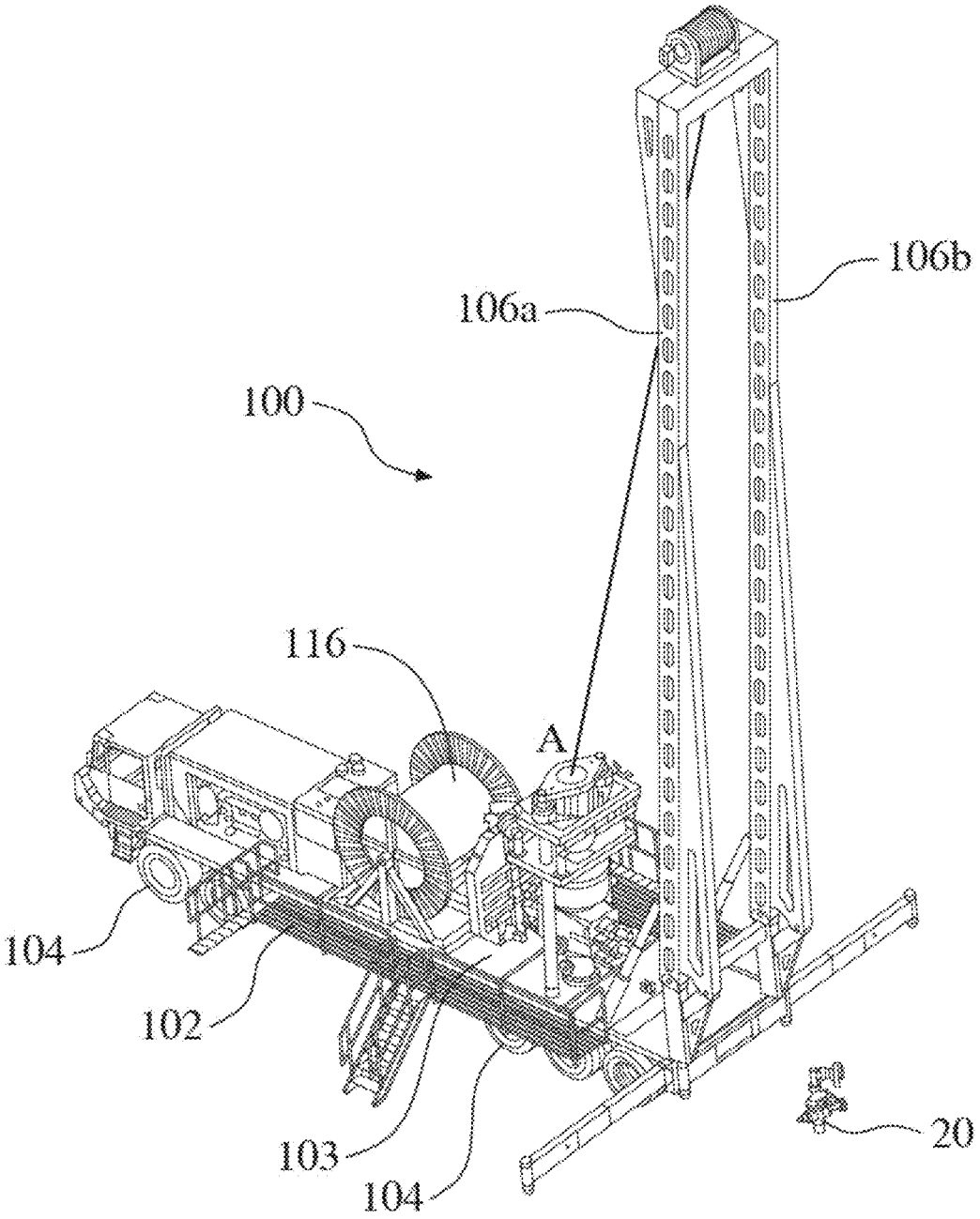
FIGS. 6A-6C are perspective views of the mobile well servicing system of FIG. 3A in an operation of moving a BOP unit, showing the BOP unit at three different positions A, B and C, respectively.
Figure 6B:
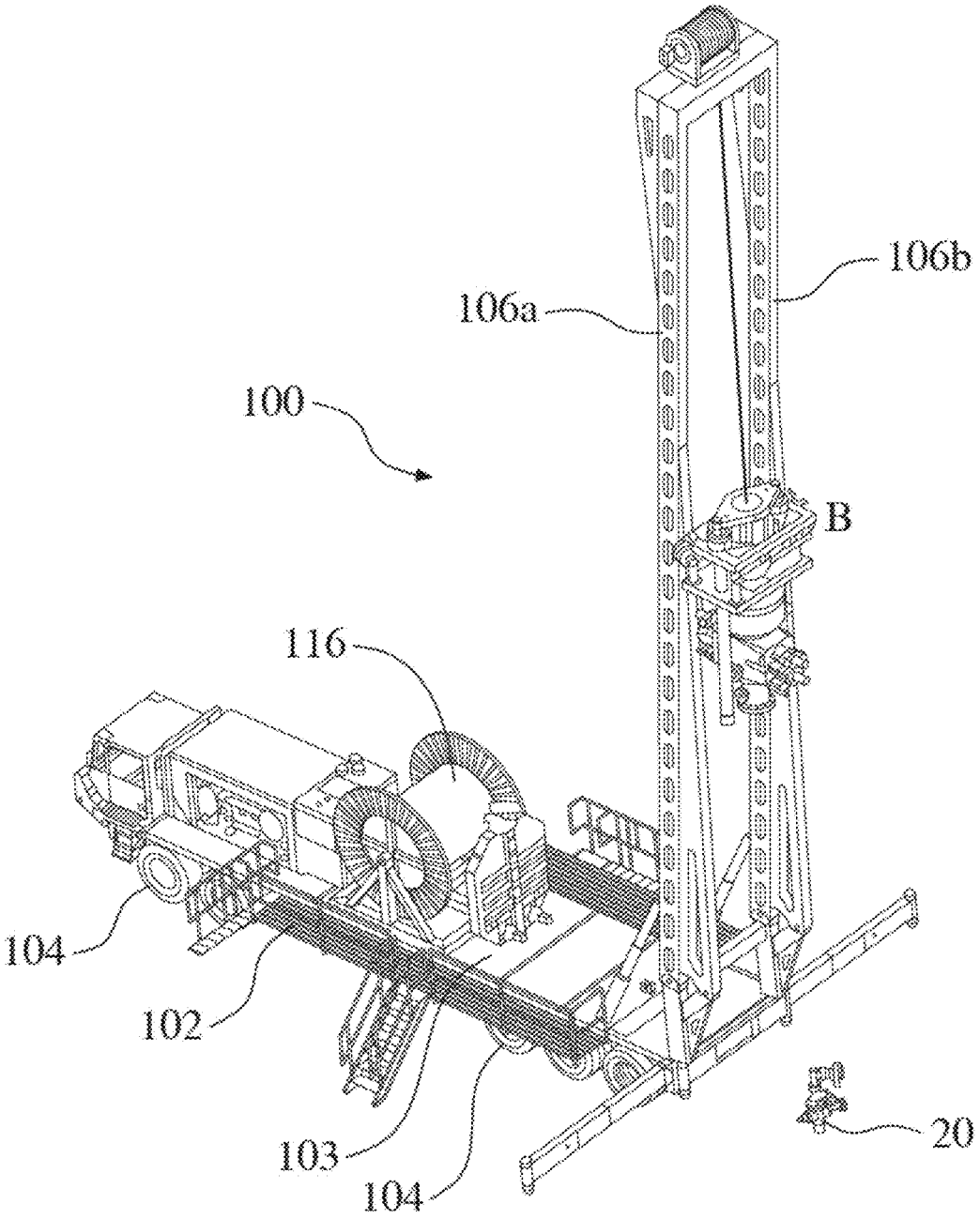
Figure 6C:
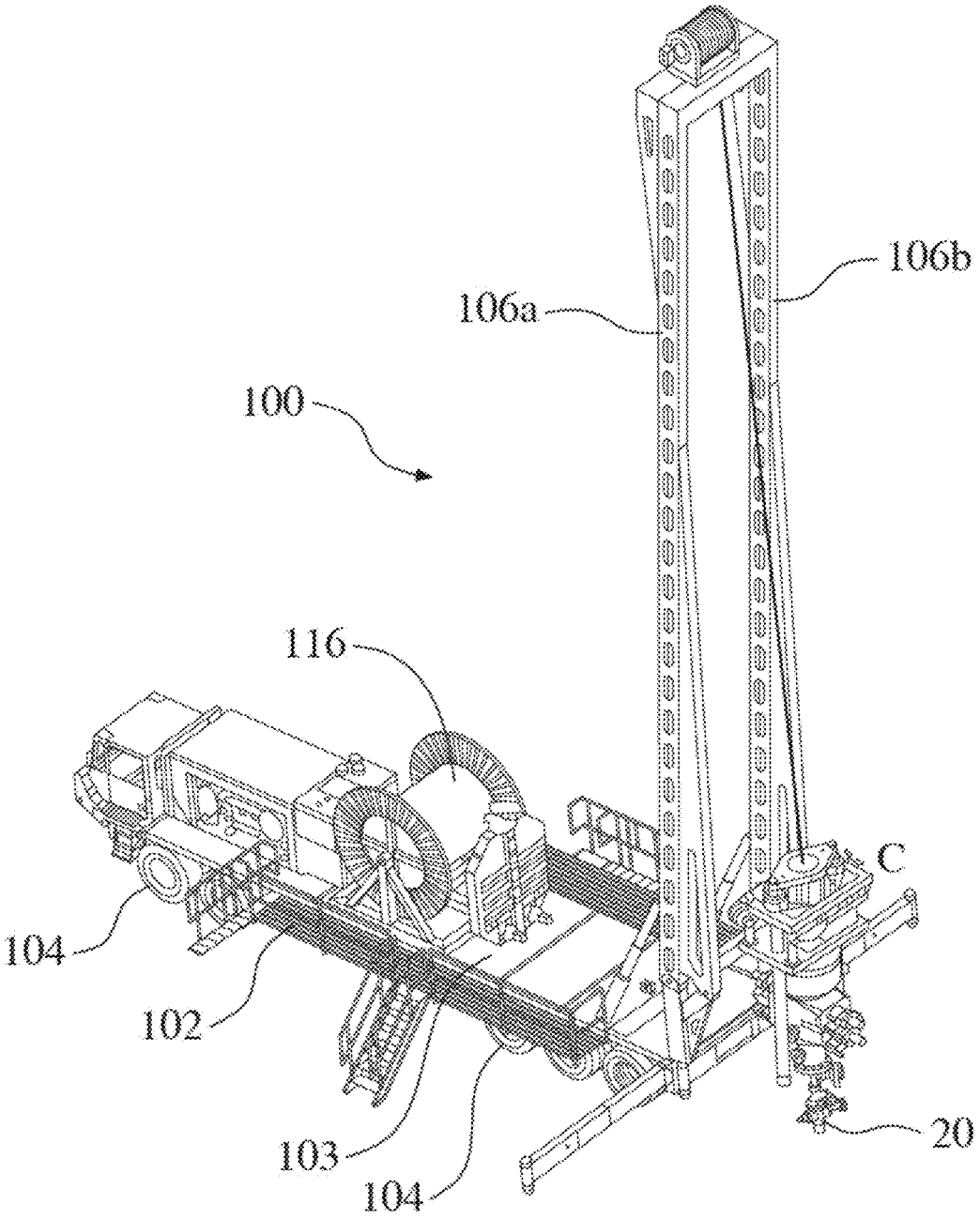
Figure 7:
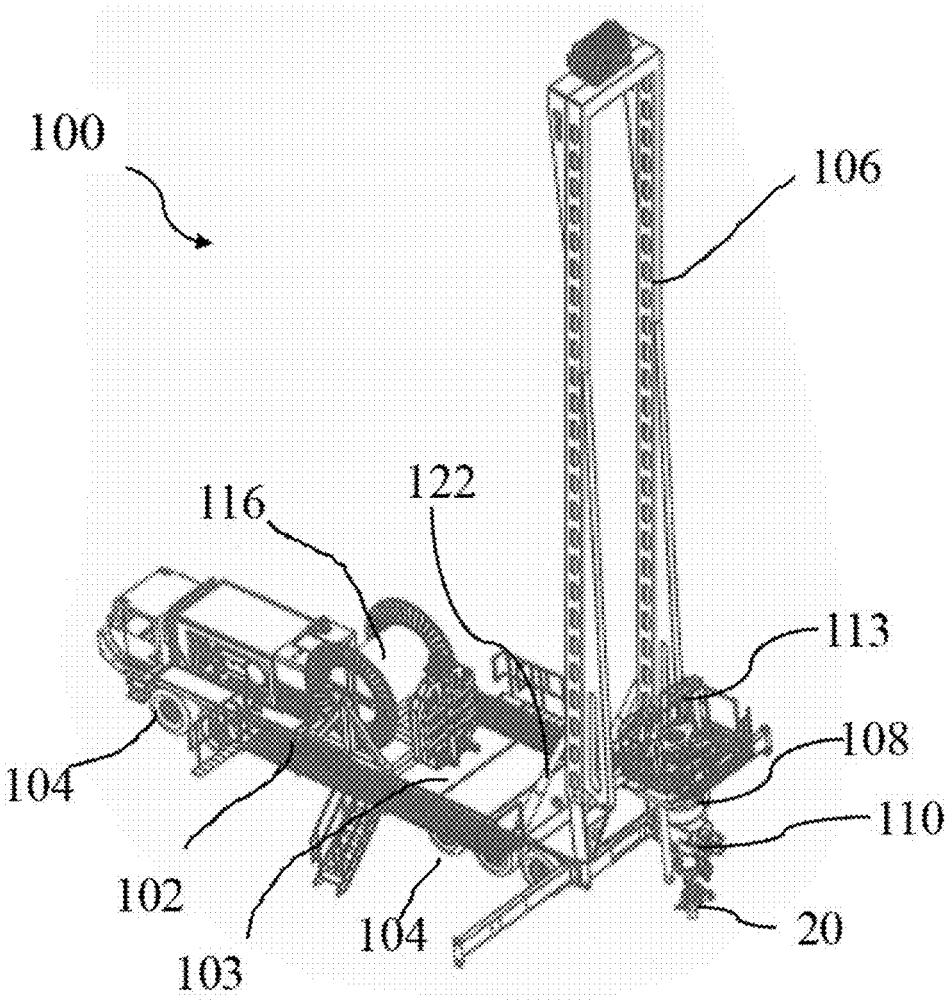
FIG. 7 is a perspective view of the mobile well servicing system of FIG. 3A with the BOP unit located at its working position.

With this compact and lightened design, multiple tasks can be achieved with the single mobile well servicing system 100, For example, FIGS. 5-7 show a process to install a BOP 110 onto a wellhead. FIG. 5 shows the mobile well servicing system 100 positioned close to the wellhead 20. The BOP 110 and the jack 108 may be stacked together as one BOP 110 on the work surface 103 of the mobile well servicing system 100. During the operation, the mast 106 may be first pivoted from its storage position on the platform 102 to its first position (or lifting position). The BOP 110 can be connected to the cable 131 of the hoist winch assembly 130 via the lifting device 133 at the end of the cable 131. The cable 131 may run up to the lifting point 127 on the transverse beam 126 on top of the mast 106 over the work surface 103. The whole BOP 110 then may be first lifted up by the hoist winch assembly 130 from position A shown in FIG. 6A to position B shown in FIG. 6B. The mast 106 is then driven by the hydraulic ram 122 to pivot towards the wellhead 20 to the second position with the lifting point 127 positioned behind the platform 102. Meanwhile, the BOP 110 passes through the passthrough space 107 between the legs 106*a* and 106*b* of the mast 106 as the mast 106 moves towards the second position. When the mast 106 is in the second position, the BOP 110 may be lowered down by the hoist winch assembly 130 from position B to its working position C as shown in FIG. 6C. The BOP 110 may then be secured to the wellhead 20 by bolts or other fastening means. The jack 108 and the work floor 113 may also be installed on top of the BOP 110 using the mobile well servicing system 100 in the same manner. In one aspect, a work floor 113 may be moved to the top of the BOP 110 following the same steps as discussed above. Field workers may stand on the work floor 113 for performing different tasks. Alternatively, the work floor 113 may be removed in order to install other servicing equipment or perform other tasks.

Figure 8:
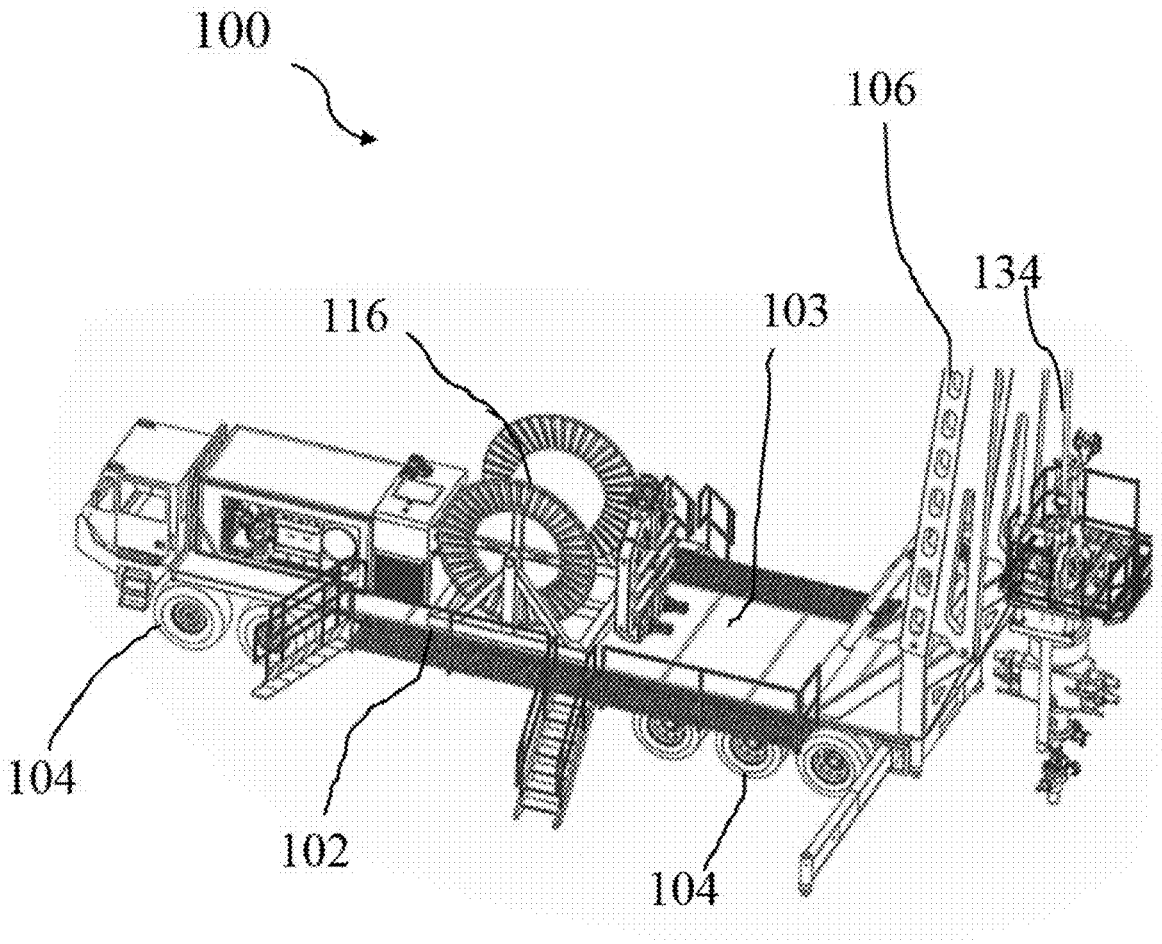
FIG. 8 is an enlarged partial view of FIG. 7.
Figure 9:
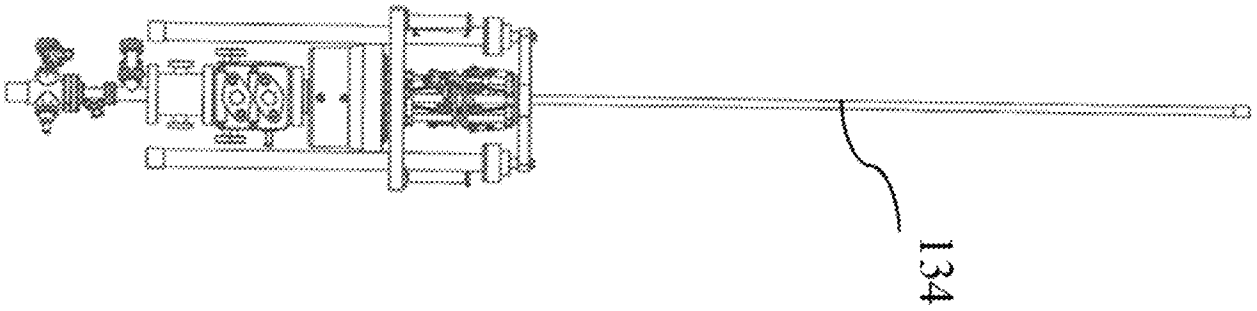
FIG. 9 is side view of the BOP unit installed on a wellhead showing the status that a guide string has been run downhole.

During the operation, the pipe or string may become stuck due to friction when being inserted into the well. Field workers may stand on the work floor 113 and use the jack 108 to push the string downhole as shown in FIG. 8. FIG. 9 shows a guide string has been inserted into the well.

Figure 10:
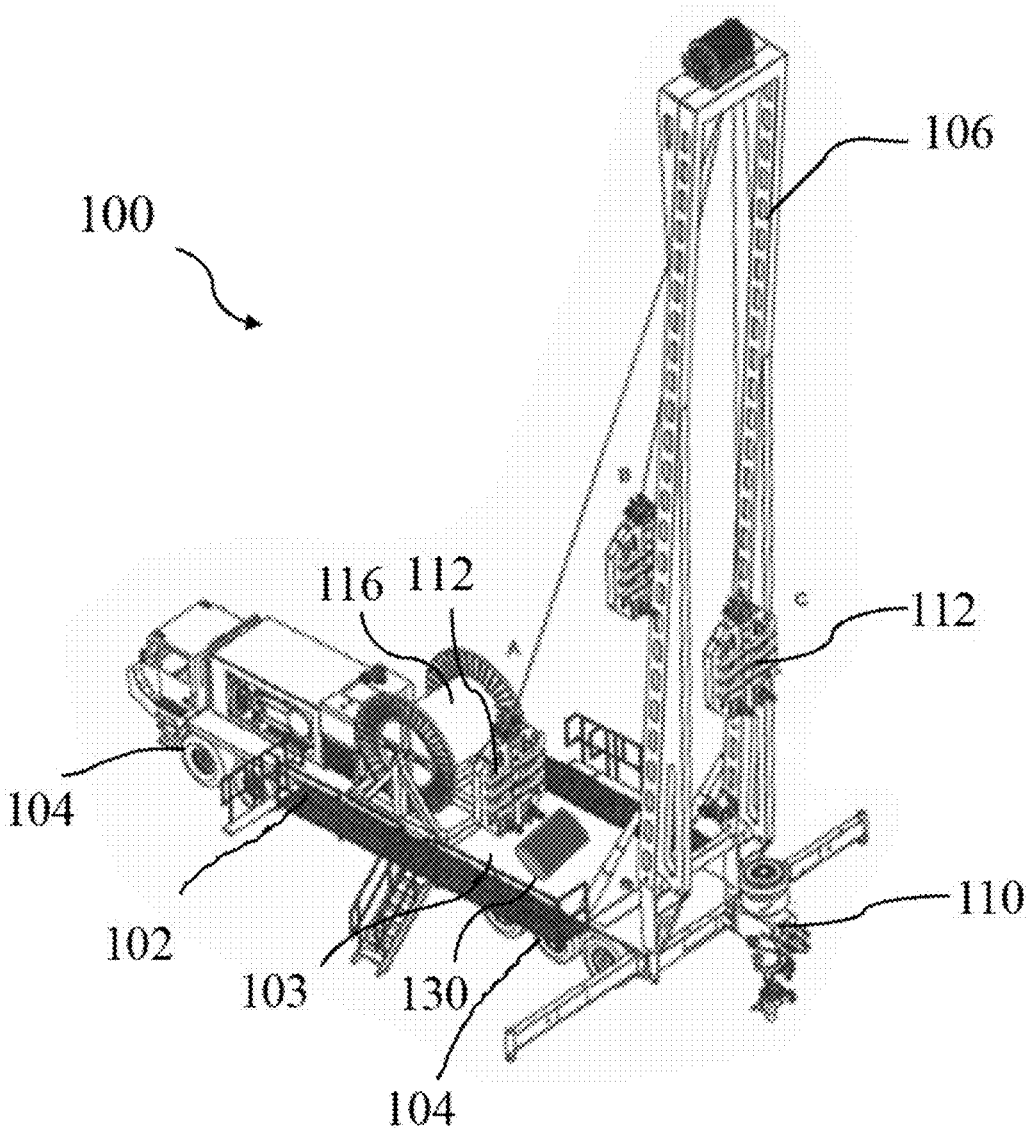
FIG. 10 is a perspective view of the mobile well servicing system of FIG. 3A in an operation of moving a CT injector.
Figure 11:
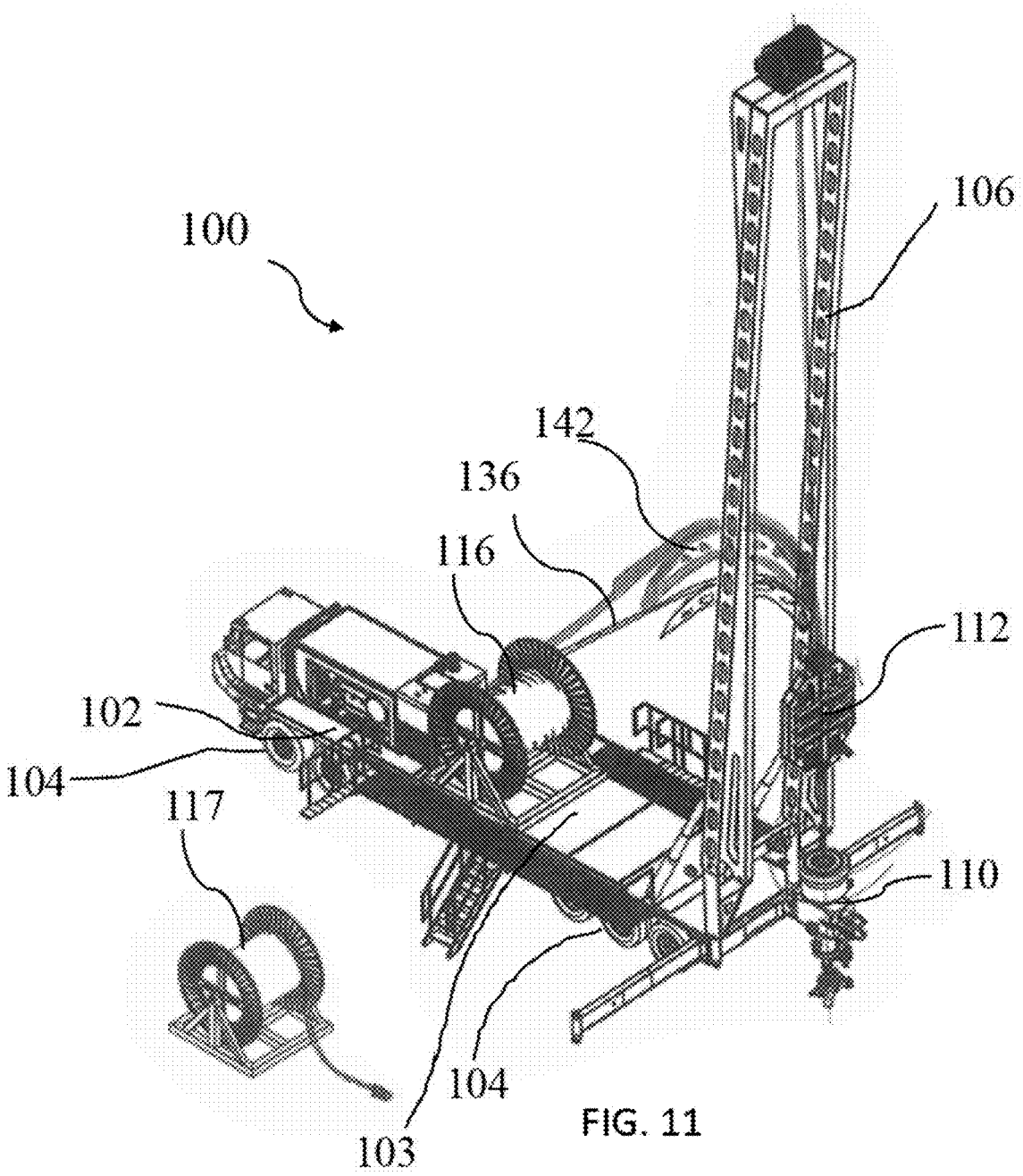
FIG. 11 is a perspective view of the mobile well servicing system of FIG. 3A with the CT injector located at its working position.
Figure 12:
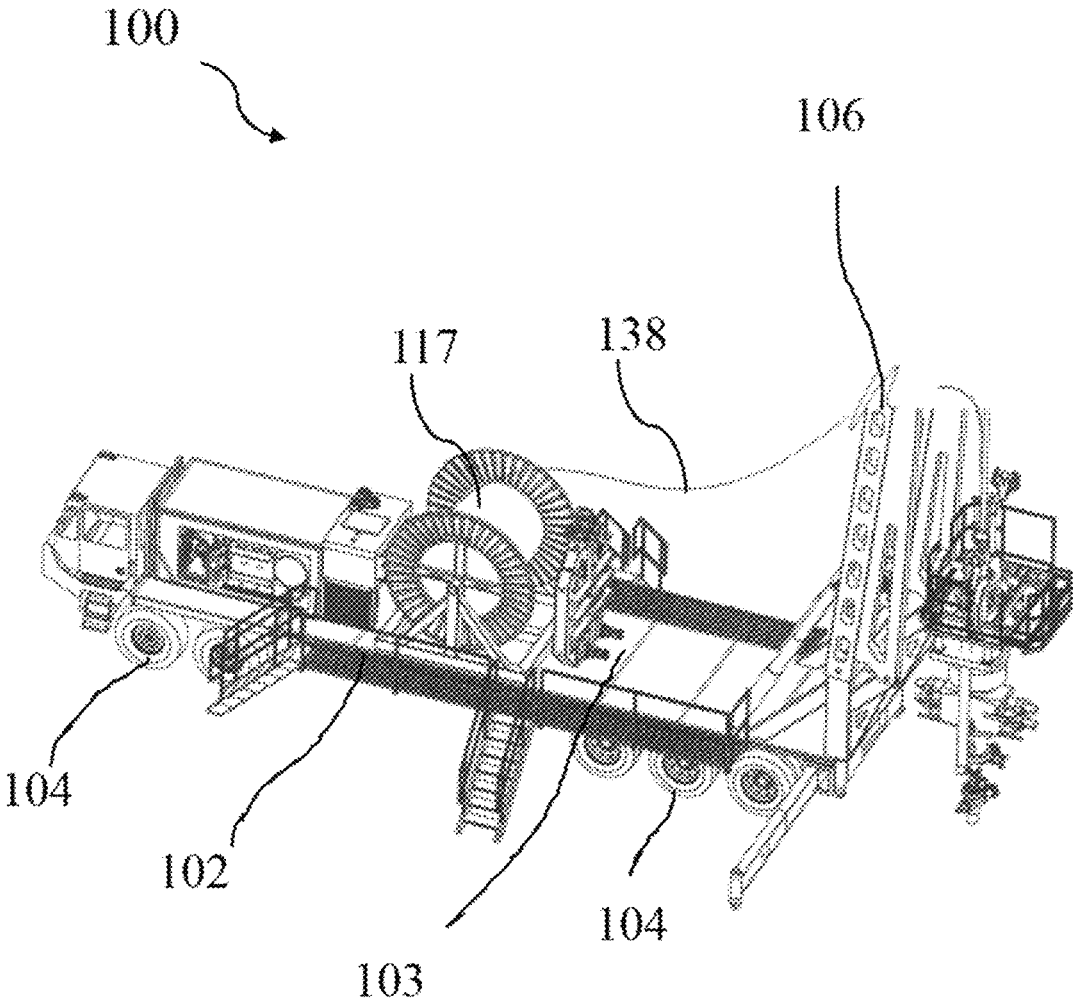
FIG. 12 is a perspective view of a portion of the mobile well servicing system of FIG. 3A having an electric submersible pump (ESP) power cable spool.

Now referring to FIGS. 10-12, a similar operation for moving the CT injector 112 using the mobile servicing system 100 is illustrated. The work floor 113 may be removed before this operation. The mast 106 can first be pivoted to the first position with the lifting point 127 positioned over the work surface 103. The CT injector 112 may be lifted up by the hoist winch assembly 130 from position A on the platform 102 to a lifted position B. The mast 106 may then be pivoted towards the wellhead 20 and the second position. As the mast 106 is pivoted from the first position to the second position, the CT injector 112 can pass through the passthrough space 107 between the legs 106*a* and 106*b* of the mast 106. When the mast 106 is in the second position, the CT injector 112 may be lowered down from position B by the hoist winch assembly 130 to position C above the BOP 110 as shown in FIG. 10. The CT injector 112 may be mounted through a stripper unit (not shown) on top of BOP 110. Once the CT injector 112 is in its working position on top of BOP 110, the coiled tubing 136 on the spool 116 on the platform 102 of the mobile well servicing system 100 is unwound and guided into the CT injector 112, and then further run into the well through BOP 110, as shown in FIG. 11. In this example, a guiding gooseneck 142 mounted on the top of the CT injector 112 may be used to guide the coiled tubing 136 into the CT injector 112.

After coiled tubing 136 has been run into the well, the coiled tubing 136 may be cut on the surface. The rest of the coiled tubing 136 left on the surface may be wound back onto the spool 116 for future use. In another aspect, the spool 116 having coiled tubing 136 may be replaced by another cable spool 117 as shown in FIGS. 11 and 12 for running power cable 138 downhole. At this stage, the work floor 113 may be brought back into the position above the wellhead 20 for further operation. It is understood by those skilled in the art that the work floor 113 can be removed from or brought into the position above the wellhead 20 according to the requirement of the operations.

Figure 13:
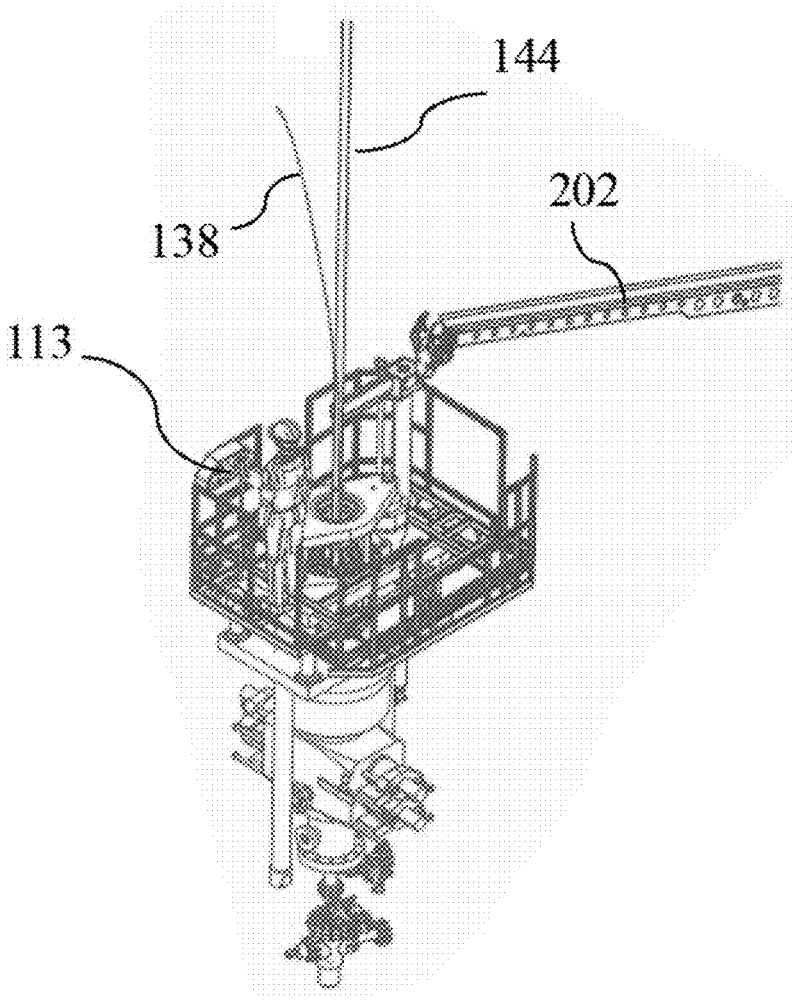
FIG. 13 is a perspective view of the BOP unit coupling to a pipe handler.
Figure 14:
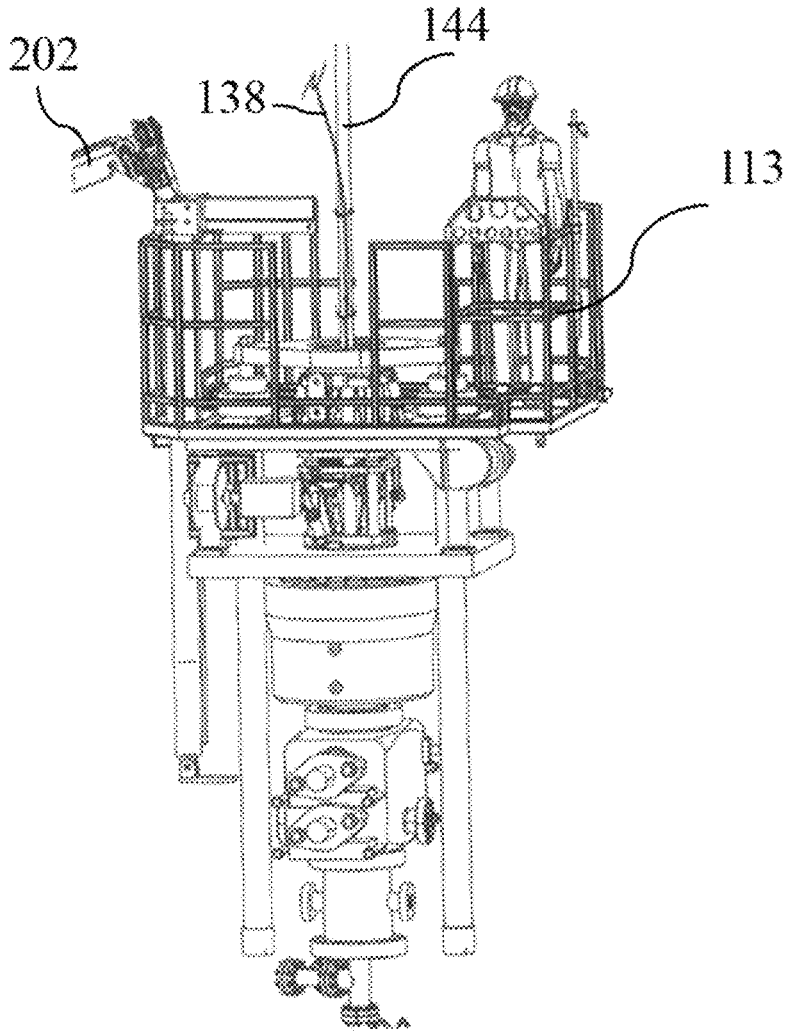
FIG. 14 is an enlarged side view of FIG. 13.
Figure 18:
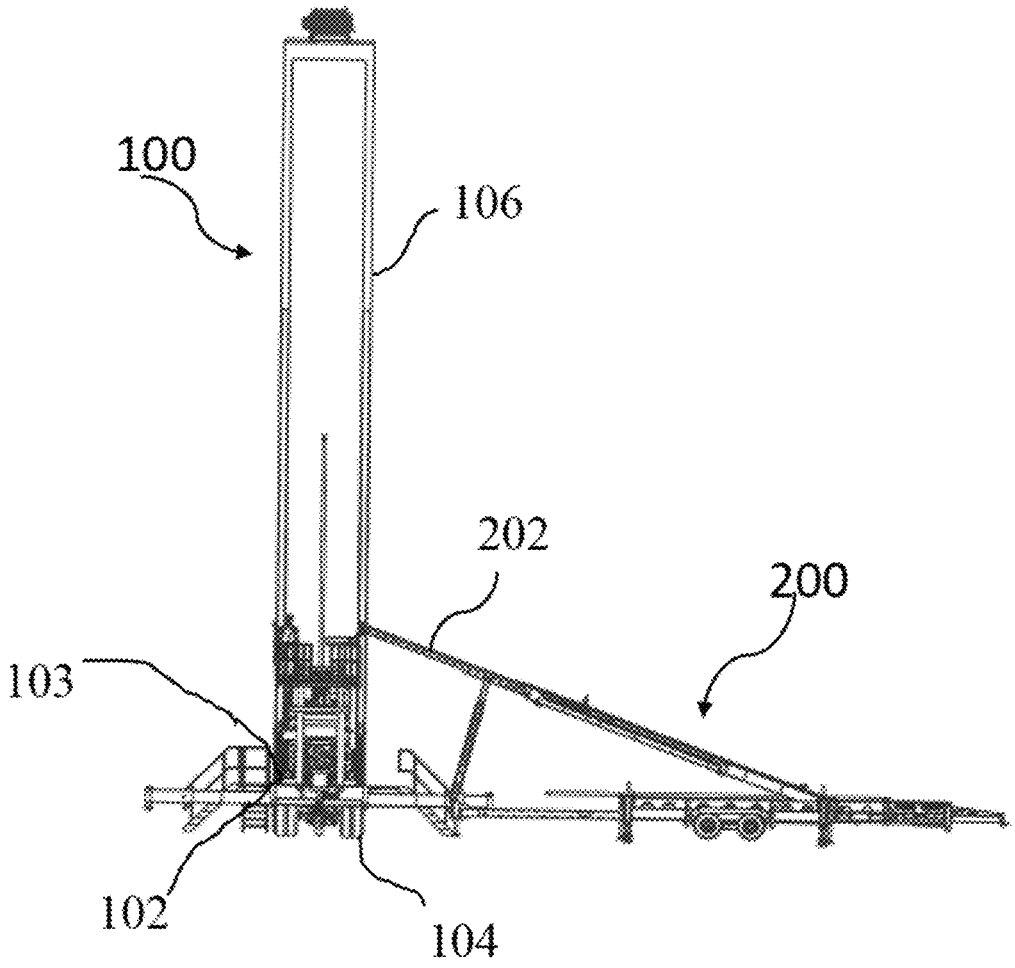
FIG. 18 is rear view of the mobile well servicing system of FIG. 3A in an operation dealing with ESP pipe string.

In another aspect, a pipe handler 200 may also be provided, either on the mobile platform 102 or on a separate platform, as shown in FIG. 1 and further in FIGS. 13, 14 and FIG. 18, for receiving pipe sections, such as jointed pipes, and for orienting said pipe sections to a substantially vertical position to be connected to a pipe string and inserted into the wellbore. As shown in the example of FIGS. 13 and 14, an handler arm 202 of the pipe handle 200 is coupled to a corner portion of the work floor 113. Pipes on the ground may be moved along the handler arm 202 up to the work floor for the field workers on the work floor to connect the pipes and insert into the wellbore. Additionally, the pipe handler can be configured to remove pipe sections that have been broken up from the pipe string in the wellbore such that they may be stored, for example on a pipe rack located on the mobile platform or provided on a separate platform. For example, with the configuration of FIGS. 13 and 14, those broken pipes after an operation can be easily removed from the work floor above the wellhead down to the ground via the handler arm 202.

Example Procedures

Multiple tasks can be performed by using the mobile well servicing system 100. The tasks may involve conventional services using jointed pipes as well as the hydraulic services using coiled tubing. Example well servicing procedures for a SAGD well using the present mobile well servicing system 100 are described below with reference to FIGS. 5-22. Such examples are not intended to be limiting, but are provided for the purpose of illustrating some exemplary methods of operating the system, and the advantages conferred thereby.

Completion (Production Well)

Figure 19:
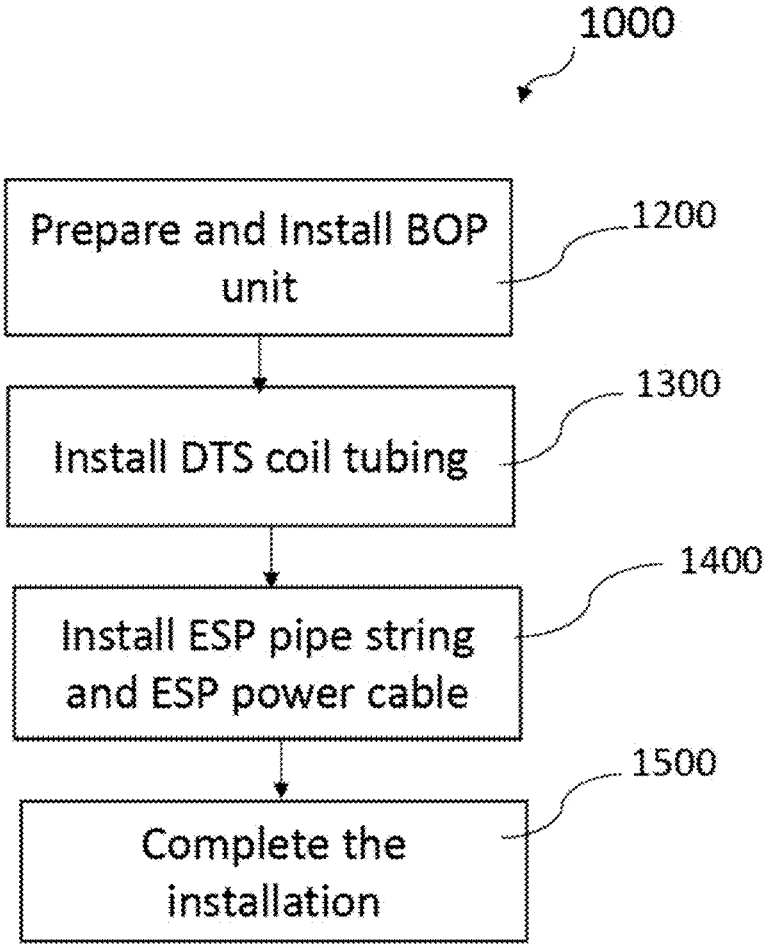
FIG. 19 is a flow chart depicting a procedure for completing a well by installing coiled tubing and an ESP.
Figure 20:
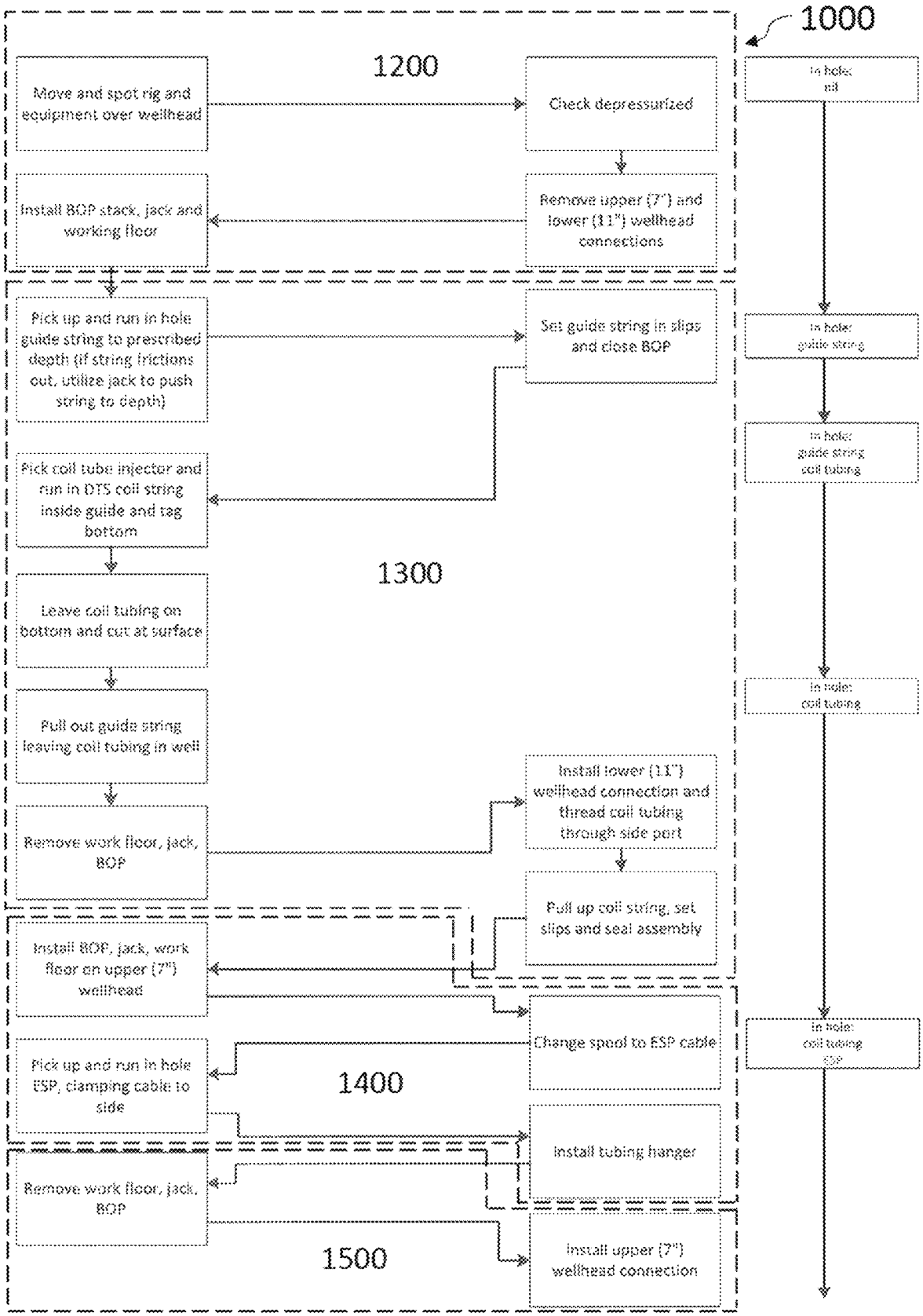
FIG. 20 is a flow chart depicting detailed steps of FIG. 19.
Figure 21:
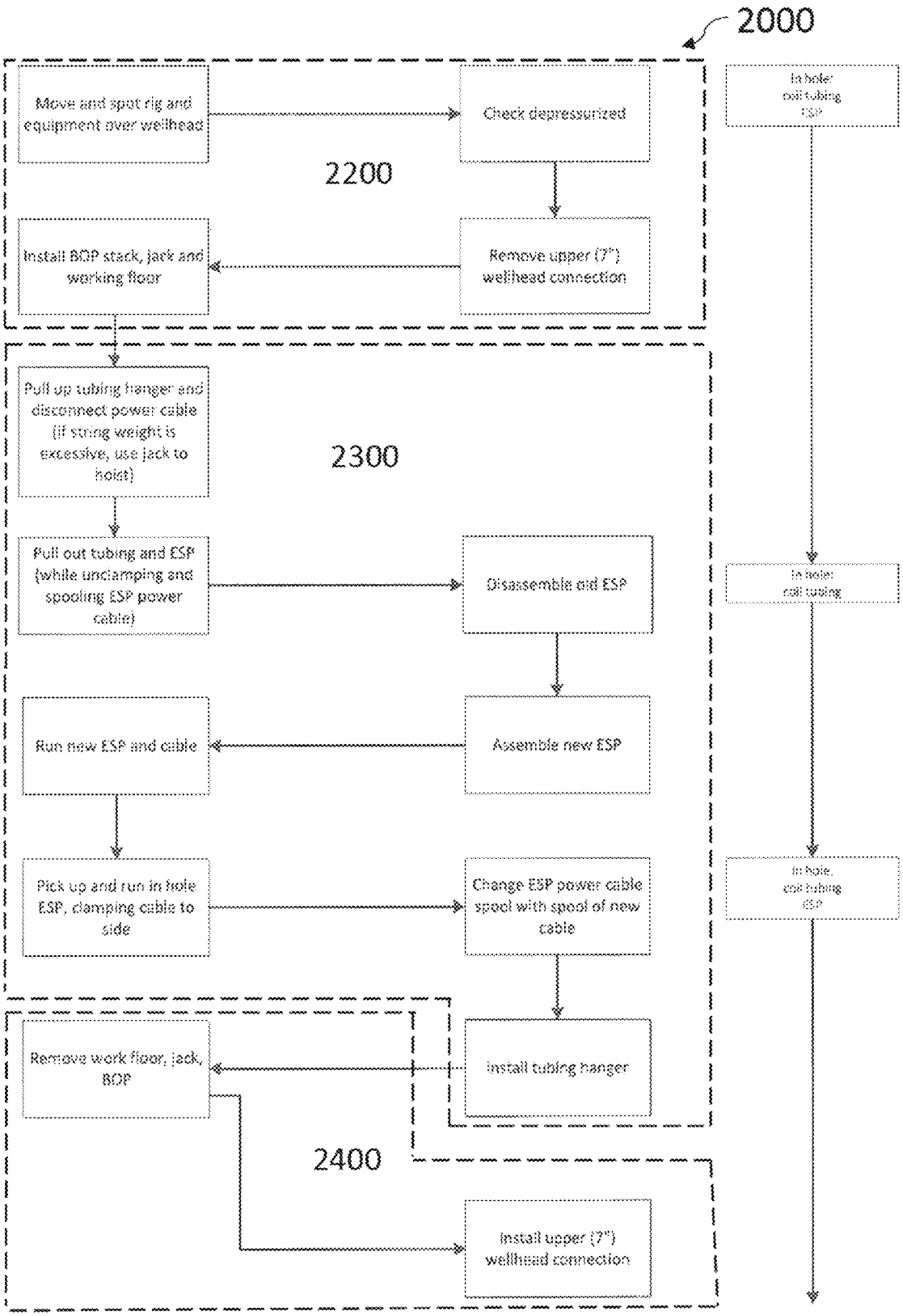
FIG. 21 is a flow chart depicting a procedure for removing and replacing an ESP in the well.

With reference to the flow chart 1000 depicted in FIGS. 19 and 20, a dynamic temperature sensor (DTS) coiled tubing and an ESP can be inserted into the well using the mobile well servicing system 100 for well completion operation. The mobile well servicing system 100 is first transported to the field site close to the wellhead for preparing and installing the BOP unit at a first step 1200. The DTS coiled tubing may be installed next at step 1300. Then the ESP may be installed at step 1400. After the installation of the DTS coiled tubing and the ESP, an upper wellhead connection is installed on the wellhead to complete the whole installation at step 1500. The well is then ready for production. The detailed procedures of each step are described with reference to the flowchart of FIG. 20.

The step of preparing and installing BOP at step 1200 may further include moving and spotting the mobile well servicing system 100 such as the rig and equipment close to the wellhead 20 as shown in FIG. 5.

Meanwhile, ensure well is depressurized.

Remove upper part of wellhead at 7" flange connection.

Remove lower part of wellhead at 11" connection.

Install 11" BOP unit including the BOP 110, the jack 108, and the work floor 113 as shown in FIGS. 6A-6C and 7. Pressure is tested.

After the BOP unit is installed, field worker may stand on the work floor 113 to perform the operation of installing the DTS coiled tubing of step 1300. The installation of the DTS coiled tubing may include first picking up and running in hole 3½" jointed pipes as a guide string 134 to prescribed depth using the jack as shown in FIGS. 8 and 9. The pipes may be conveyed from the handler arm 202 to the work floor 113. The jack can be used to push the guide string downhole if the string becomes stuck due to friction.

Then, set the guide string 134 in slips and close BOP. Pick coiled tubing injector 112 with the hoist winch assembly 130, install it above the wellhead 20, and run in 1¼" DTS coiled tubing 136 inside the guide string 134 and tag bottom as shown in FIGS. 10 and 11.

Leave coiled tubing on bottom and cut it at surface just above guide string 134.

Pull out and lay down 3½" guide string 134 and leave coiled tubing 136 in well.

Remove the work floor 113, the jack 108 and the BOP 110.

Install lower part of wellhead at 11" connection, thread DTS coiled tubing through side port on wellhead.

Pull up on coiled tubing using CT injector to get the bottom of the coiled tubing about 13 m from bottom of well to allow for expansion.

Set coiled tubing in wellhead slips and install sealing assembly. The installation of the DTS coiled tubing at step 1300 is finished now.

In order to install ESP at step 1400, the BOP unit including the BOP 110, the jack 108 and the work floor 113 may be reinstalled on 7" connection on upper part of the wellhead again.

The installation of ESP at step 1400 may further include changing the spool 116 on platform 102 of the mobile well servicing system 100 to accommodate ESP power cable spool 117 having ESP power cable 138 as shown in FIGS. 11 and 12.

Figure 15:
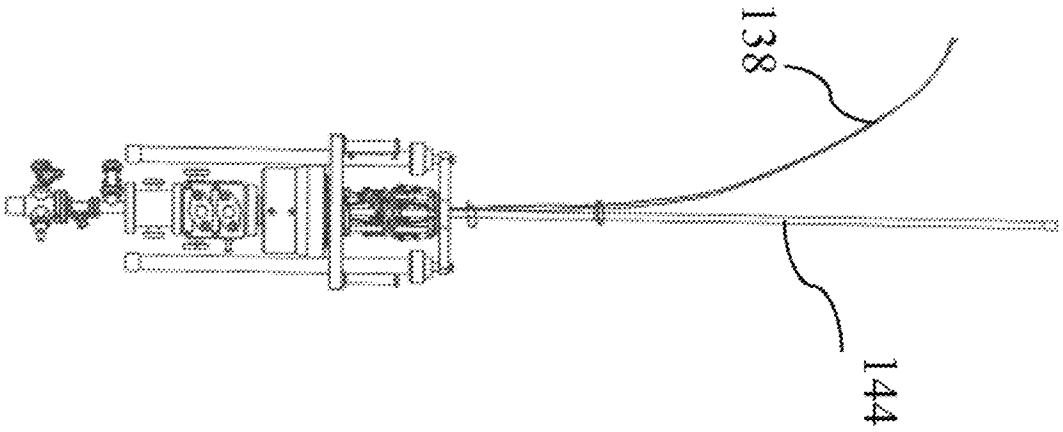
FIG. 15 is side view of the BOP unit installed on the wellhead showing the status that a ESP power cable and a ESP pipe string have been run downhole.

The field workers may stand on the work floor 113 to pick up and run in hole ESP pipe string 144 containing ESP using jack, clamping power cable 138 to side of ESP pipe string 144 as shown in FIGS. 13-15.

Install ESP tubing hanger.

Figure 16:
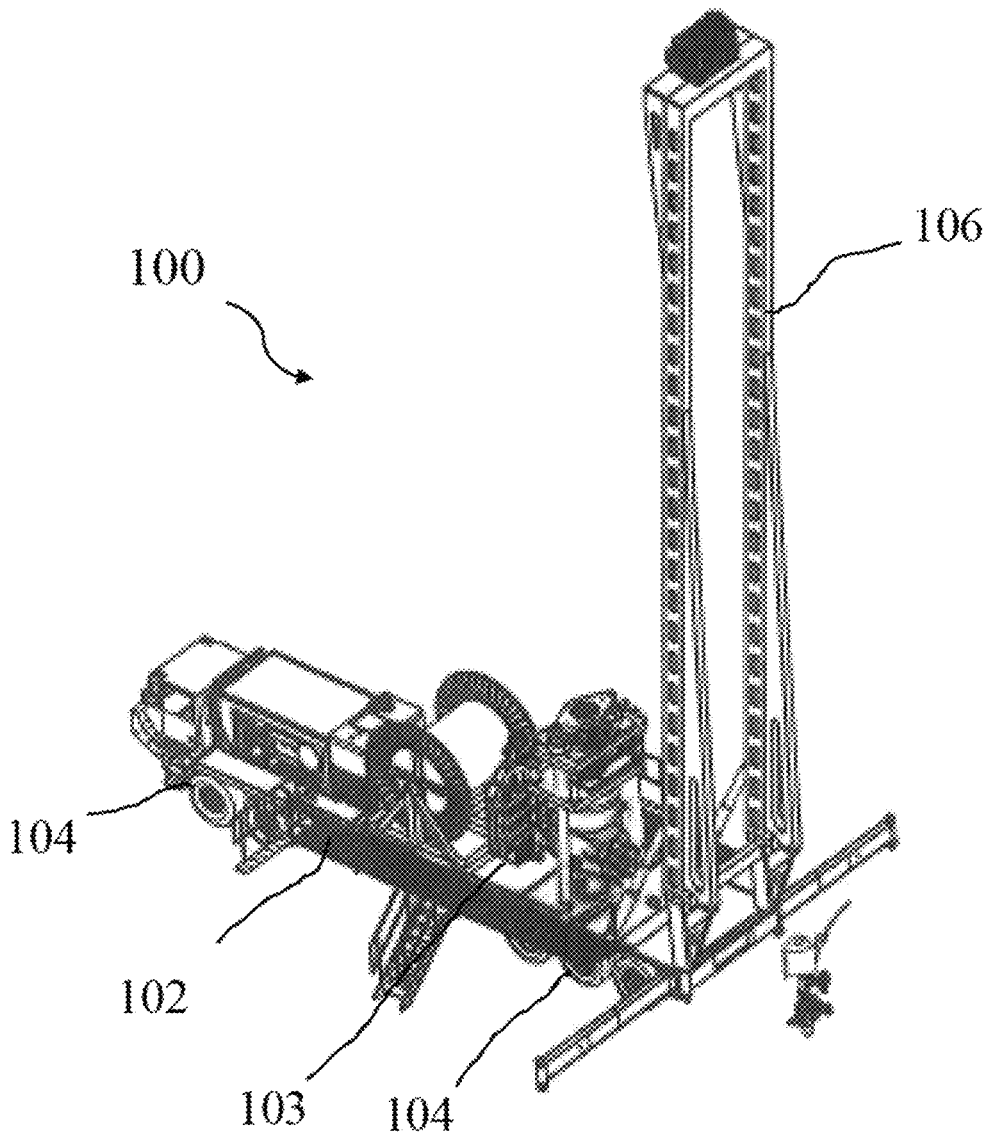
FIG. 16 is a perspective view of the mobile well servicing system of FIG. 3A showing a status that well completion is finished and ready for production.

After the ESP tubing hanger is installed, the final completing step 1500 may include removing the work floor 113, the jack 108 and the BOP 110. Then install upper part of wellhead at the 7" connection as shown in FIG. 16. The well is now ready for production.

Electric Submersible Pump (ESP) Change
(Production Well)

In addition to the completion operation, the mobile well servicing system 100 can be used for performing other operations. With reference to the flow chart depicted in FIG. 21, an ESP can be removed from the well and replaced with a new ESP by using the mobile well servicing system 100. The ESP changing operation may include preparing and installing the BOP unit at step 2200, changing ESP at step 2300 and completing the installation at step 2400. Details of each step are discussed with reference to the following procedures.

Similar to the completion operation, the step of preparing and installing the BOP unit at step 2200 may include moving and spotting the mobile well servicing system 100 such as rig and equipment close to the wellhead 20 as shown in FIG. 5.

Meanwhile, ensure well is depressurized.

Remove upper part of wellhead at 7" flange connection.

Install the BOP unit including the BOP 110, the jack 108, and the work floor 113. The preparation step 2200 is finished.

Next, the changing ESP step 2300 may include pulling up the tubing hanger of ESP pipe string and disconnect power cable from the ESP pipe string. If the weight of the ESP pipe string exceeds the capacity of the mast and hoist winch assembly, the jack can be used to hoist the tubing hanger.

Figure 17:
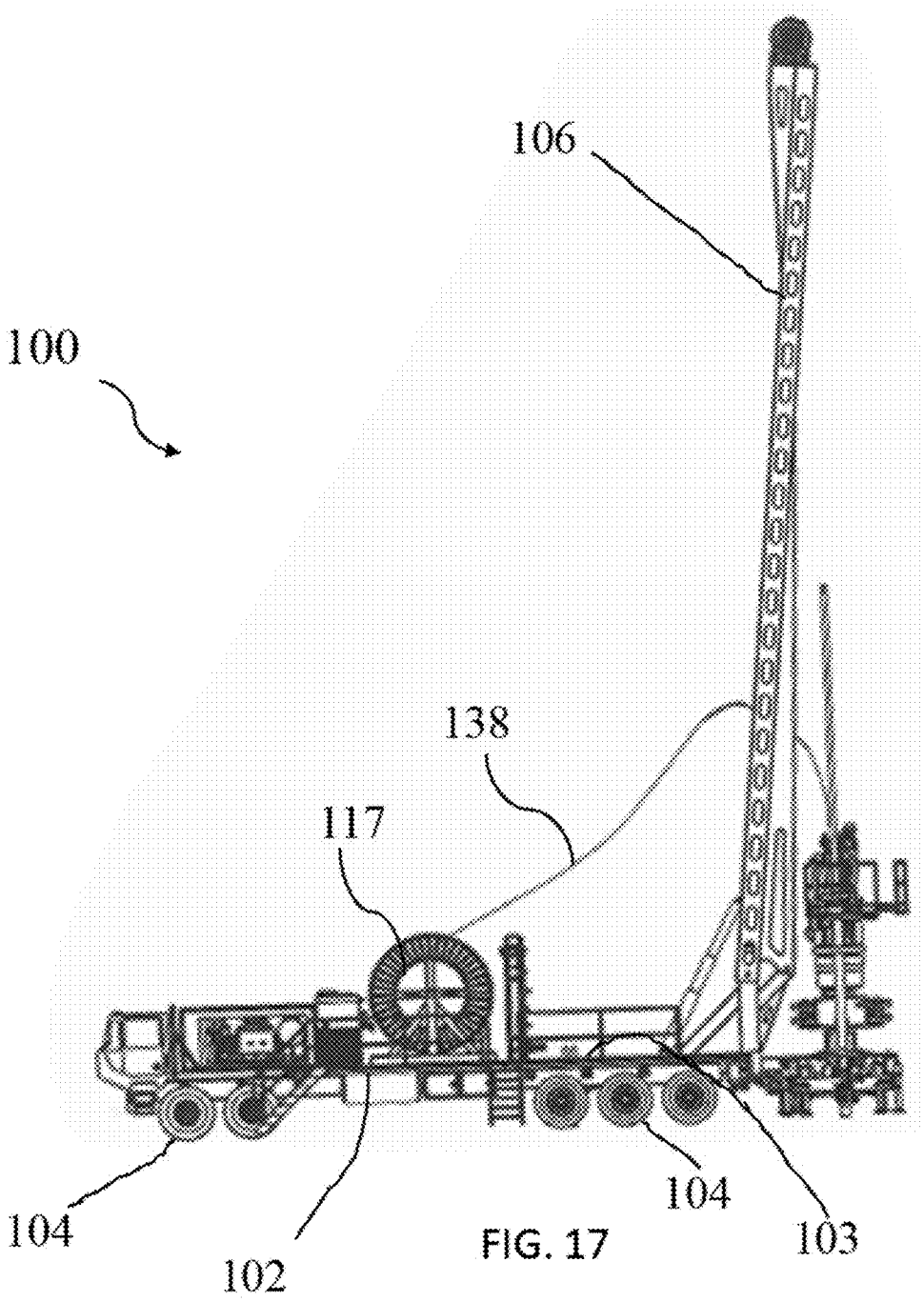
FIG. 17 is a side view of the mobile well servicing system of FIG. 3A in an operation dealing with ESP power cable.

Then, pull out of well production tubing and ESP pipe string using jack at the same time as un-clamping and spooling ESP power cable onto ESP cable spool 117 on mobile platform 102 as shown in FIGS. 17 and 18. The pipes of the ESP pipe string may be moved down via the handler arm 202.

Disassemble ESP from the ESP pipe string when it is at surface.

Assemble a new ESP.

Change ESP power cable spool with a spool of new cable.

Run in new ESP using jack and ESP power cable.

Pick up and run in hole a new ESP, clamping power cable to side of ESP pipe.

Install ESP tubing hanger.

After the new ESP has been installed, the final completing step 2400 may include removing the work floor 113, the jack 108, and the BOP 110 using the hoist winch assembly 130, and installing upper part of wellhead at the 7" connection, which is similar to the step 1500 of the completing procedure as shown in FIG. 16.

Dynamic Temperature Sensor (DTS) Change
(Production Well)

Figure 22:
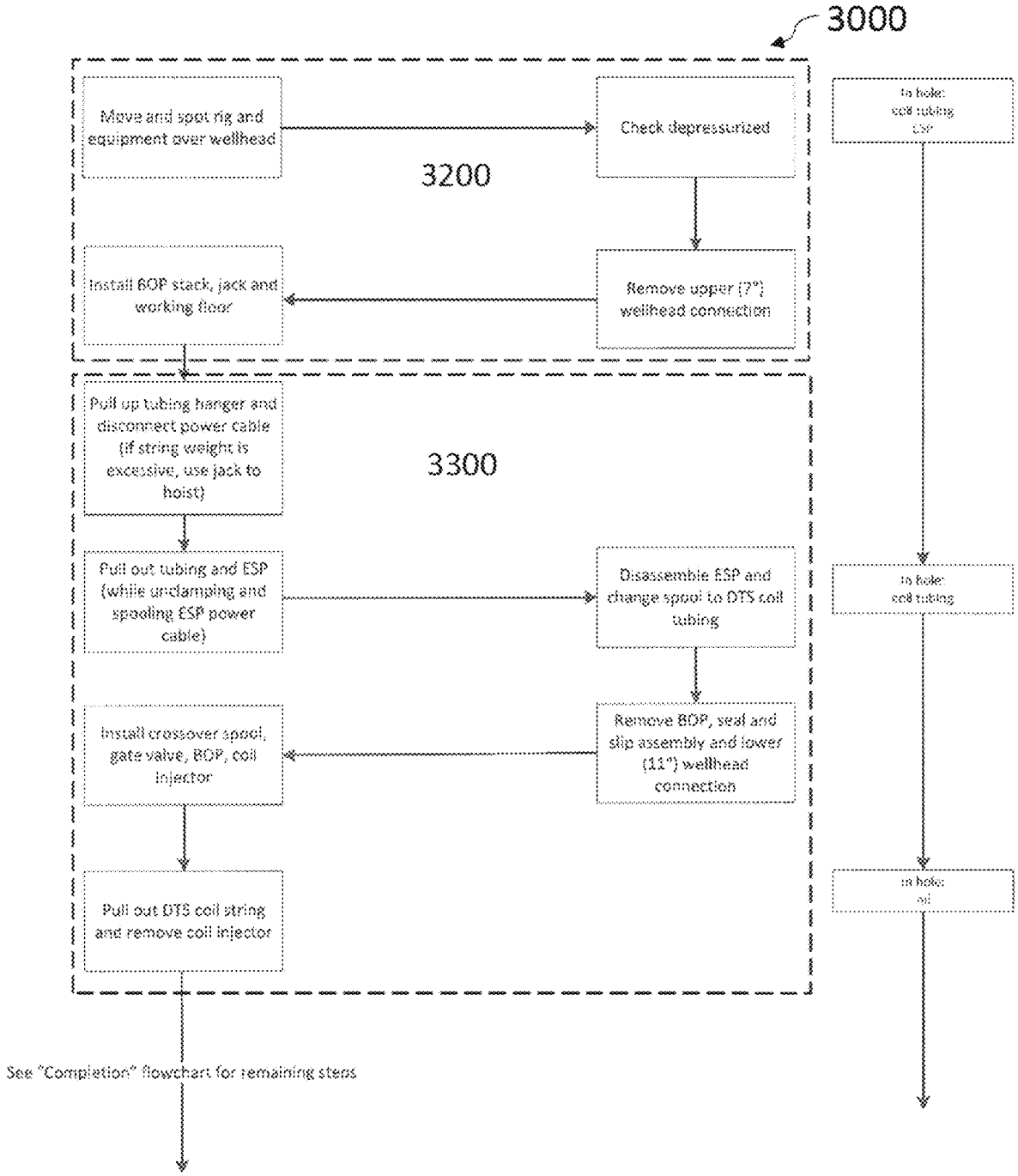
FIG. 22 is a flow chart depicting a procedure for removing and replacing a dynamic temperature sensor (DTS) coiled tubing in the well.

With reference to the flow chart depicted in FIG. 22, a DTS coiled tubing can be removed from the well and replaced using the following procedure:

The preparation step 3200 of changing DTS may include moving and spotting the mobile well servicing system 100 such as the rig and equipment close to the wellhead.

Meanwhile, ensure well is depressurized.

Remove upper part of wellhead at 7" flange connection.

Install the BOP unit including the BOP 110, the jack 108, and the work floor 113. The preparation step 2200 is finished.

Next, the step 3300 for removing current DTS and ESP may include pulling up tubing hanger of ESP pipe string and disconnecting power cable from pipe string. If the weight of the ESP pipe string exceeds the capacity of the mast and the hoist winch assembly, the jack can be used to hoist the hanger.

Then pull out of well production tubing and ESP pipe string using jack at the same time as un-clamping and spooling ESP power cable 138 onto ESP cable spool 117 on the platform 102.

Dis-assemble ESP when it is at surface.

Change ESP cable spool with DTS coiled tubing spool on the platform 102, as shown in FIG. 12 again.

Remove BOP from 7" wellhead connection.

Remove seal and slip assembly from DTS coiled tubing on lower part of wellhead, let coil string sit on bottom.

Remove lower part of wellhead at 11" connection.

Install 7"×11" cross over spool on 11" wellhead connection.

Install 7" gate valve on cross over spool.

Install annular coil BOP and CT injector on 7" valve using hoist winch assembly as shown in FIG. 10.

Pull out of well DTS coiled tubing onto the coiled tubing spool 116 on the platform 102.

Remove CT injector, 7" valve and crossover spool from wellhead.

After the current DTS and ESP have been removed, it will repeat the steps of installing DTS and ESP as described at steps 1300 and 1400 of FIG. 20, which may include the following procedures:

Install 11" Bop stack, jack and working floor, pressure test.

Pick up and run in hole 3½" jointed guide string to prescribed depth using jack.

Set guide string in slips and close BOP.

Pick coiled tubing injector with hoist winch assembly and run in 1¼" DTS coil string inside guide string and tag bottom.

Leave coiled tubing on bottom and cut it at surface just above guide string.

Pull out and lay down 3½" guide string leaving coiled tubing in well.

Remove work floor, jack and BOP.

Install lower part of wellhead at 11" connection, thread DTS coiled tubing through side port on wellhead.

Pull up on coiled tubing string to get the bottom of the coiled tubing string about 13 m from bottom of well to allow for expansion.

Set coiled tubing in wellhead slips and install sealing assembly.

Install BOP, jack and work floor on 7" connection on upper part of wellhead.

Change the spool 116 on the platform 102 to accommodate Electric Submersible Pump power cable.

Pick up and run in hole ESP using jack, clamping power cable to side of ESP pipe string.

Install ESP tubing hanger.

Remove the work floor, the jack and the BOP.

Install upper part of wellhead at the 7" connection.

Although particular operations using the mobile well servicing system have been described herein, these particular operations are demonstrative. Other operations may be conducted by the system as known to one of skill in the art.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A mobile well servicing system comprising a platform supported by a plurality of wheels a work surface supported by the platform;

a first servicing equipment positionable on the work surface;

a mast comprising two parallel legs having proximal ends and distal ends, the proximal ends pivotally connected to the platform, a lifting point positioned at the distal ends of the two parallel legs, and a passthrough space defined between the two parallel legs; and a hoist winch assembly including a drawworks located on the platform, and a lifting device connectable to the first servicing equipment and suspended from the lifting point;

wherein the mast is pivotable around the proximal ends of the two parallel legs between a first position, with the lifting point positioned over the work surface, and a second position, with the lifting point positioned behind the platform, and wherein the first servicing equipment is raised off of the work surface of the platform by the hoist winch assembly when the mast is in the first position, the first servicing equipment is then moved through the passthrough space as the mast is moved towards the second position and when the mast is in the second position, the hoist winch assembly lowers the first servicing equipment to a wellhead.

2. The mobile servicing system of claim 1 wherein each of the two parallel legs are telescoping between a lowered positioned and a raised position.

3. The mobile servicing system of claim 2 wherein each of the two parallel legs comprises a hollow main leg and a telescoping leg received in the hollow main leg, the telescoping leg being extendable.

4. The mobile servicing system of claim 2 wherein the two parallel legs are in the lowered positioned when the mast is moved from the first position to the second position.

5. The mobile servicing system of claim 2 wherein the two parallel legs are moved from the lowered position to the raised position when the mast is in the second position.

6. The mobile servicing system of claim 1 wherein each of the two parallel legs comprise at least one aperture.

7. The mobile servicing system of claim 1 further comprising a hydraulic system supported by the platform with hydraulic lines to supply pressurized hydraulic fluid to the first servicing equipment.

8. The mobile servicing system of claim 7 wherein the hoist winch assembly is supplied with pressurized hydraulic fluid from the hydraulic system.

9. The mobile well servicing system of claim 7, wherein the hydraulic system supplies pressurized hydraulic fluid to pivot the mast around the distal ends proximal ends of the two parallel legs.

10. The mobile servicing system of claim 1 wherein the first servicing equipment is at least one of: a jack; a blowout preventer; a coiled tubing injector; and, a work floor.

11. The mobile well servicing system of claim 10, wherein the work floor comprises a corner portion configured to couple with a handler arm of a pipe handle adjacent to the mobile well servicing system for conveying pipes.

12. The mobile servicing system of claim 1 wherein the distal ends of the parallel legs of the mast are connected by a transvers beam and the lifting position point is positioned on the transverse beam.

13. The mobile servicing system of claim 1 wherein the passthrough space is unobstructed.

14. The mobile servicing system of claim 1 wherein the mast is pivotal around the proximal ends of the two parallel legs to a recumbent position with the mast substantially horizontal to the platform.

15. The mobile well servicing system of claim 1, further comprising a second servicing equipment.

16. The mobile well servicing system of claim 15 wherein the first servicing equipment is a blowout preventer and the second servicing equipment is a work floor and wherein the blowout preventer is mounted on the wellhead and the work floor is mounted on the blowout preventer.

17. The mobile well servicing system of claim 15 wherein the first servicing equipment is a blowout preventer and the second servicing equipment is a jack.

18. The mobile well servicing system of claim 1, further comprising a stand provided on the working surface and rotatably supporting a wireline spool.

19. The mobile well servicing system of claim 18, wherein the wireline spool is one of: a coiled tubing (CT) spool; and, a power cable spool.

20. The mobile well servicing system of claim 1, wherein the mobile well servicing system is a vehicle.

21. A method of performing well services, comprising:

providing a well servicing system comprising:

a platform supported by a plurality of wheels;

a work surface supported by the platform;

a first servicing equipment positionable on the work surface;

a mast comprising two parallel legs having proximal ends and distal ends, the proximal ends pivotally connected to the platform, a lifting point positioned at the distal ends of the two parallel legs, and a passthrough space defined between the two parallel legs; and a hoist winch assembly having a lifting device connectable to the first servicing equipment and suspended from the lifting point;

moving the well servicing system close to a wellhead of a well;

raising the mast from a recumbent position where the mast is substantially horizontal to the platform;

pivoting the mast around the proximal ends of the two parallel legs to a first position, with the lifting point positioned over the work surface;

using the hoist winch assembly, lifting the first servicing equipment off of the work surface;

pivoting the mast around the proximal ends of the two parallel legs and moving the first servicing equipment through the passthrough space, to a second position with the lifting point positioned behind the platform and over the wellhead;

using the hoist winch assembly, lowering the first servicing equipment to the wellhead.

22. The method of claim 21 further comprising installing the first servicing equipment on the wellhead.

23. The method of claim 22, further comprising moving the mast back to the first position after a first well service is completed by the first servicing equipment; lifting a second servicing equipment off the work surface of the platform; pivoting the mast around the proximal ends of the two parallel legs and moving the second servicing equipment through the passthrough space as the mast is moved towards the second position; and lowering the second servicing equipment to the wellhead when the mast is in the second position.

24. The method of claim 22, further comprising connecting a second servicing equipment with the first servicing equipment together on the work surface of the platform to form a connected first servicing equipment and second servicing equipment; lifting the connected first servicing equipment and second servicing equipment off the work surface of the platform when the mast is in the first position; pivoting the mast around the proximal ends of the two parallel legs and moving the connected first servicing equipment and second servicing equipment through the passthrough space as the mast is moved towards the second position; and lowering the connected first servicing equipment and second servicing equipment to the wellhead when the mast is in the second position.

25. The method of claim 21 wherein the first servicing equipment is at least one of: a jack; a blowout preventer; a coiled tubing injector; and, a work floor.

26. The method of claim 21, further comprising extending the legs of the mast at second position to place the mast in a full operational position.

27. The method of claim 26 further comprising performing a well service on the wellhead.

28. The method of claim 27 wherein the well service involves at least one of: inserting pipes into the well; and running coiled tubing, while the mast in the full operational position.

29. The method of claim 27, wherein the well service includes at least one of: installing an electric submersible pump in the well; changing an electric submersible pump; changing power cable in the well; installing a dynamic temperature sensor in the well; and changing a dynamic temperature sensor in the well.

* * * * *